US008449265B2

(12) United States Patent
Marica

(10) Patent No.: US 8,449,265 B2
(45) Date of Patent: May 28, 2013

(54) HYDRAULICALLY ACTUATED RECIPROCATING PUMP

(75) Inventor: Adrian Marica, Cypress, TX (US)

(73) Assignee: National Oilwell Varco, L.P., Houston, TX (US)

( * ) Notice: Subject to any disclaimer, the term of this patent is extended or adjusted under 35 U.S.C. 154(b) by 431 days.

(21) Appl. No.: 12/787,476

(22) Filed: May 26, 2010

(65) Prior Publication Data

US 2011/0293447 A1 Dec. 1, 2011

(51) Int. Cl.
*F04B 49/00* (2006.01)

(52) U.S. Cl.
USPC ..... 417/215; 417/395

(58) Field of Classification Search
USPC ..... 417/215, 340, 395, 396, 900; 92/50, 92/75
See application file for complete search history.

(56) References Cited

U.S. PATENT DOCUMENTS

| | | | | |
|---|---|---|---|---|
| 1,739,096 | A | 12/1929 | Seifert | |
| 2,204,854 | A | 6/1940 | Hambly | |
| 2,283,207 | A | 5/1942 | Hollander | |
| 2,673,525 | A | 3/1954 | Lucas | |
| 2,703,055 | A | 3/1955 | Veth et al. | |
| 2,849,026 | A | 8/1958 | Taplin | |
| 3,168,045 | A * | 2/1965 | Sebastiani | 417/383 |
| 3,236,158 | A | 2/1966 | Taplin | |
| 3,269,276 | A | 8/1966 | Natanson | |
| 3,283,670 | A | 11/1966 | Taplin | |
| 3,372,624 | A | 3/1968 | Rietdijk | |
| 3,373,694 | A | 3/1968 | Taplin | |
| 3,375,759 | A | 4/1968 | Smith | |
| 3,403,603 | A | 10/1968 | Turner | |
| 3,619,087 | A | 11/1971 | Beeman | |
| 3,934,480 | A | 1/1976 | Nederlof | |
| 3,969,991 | A | 7/1976 | Comstock et al. | |
| 4,297,982 | A * | 11/1981 | Lakra | 123/502 |
| 4,386,888 | A | 6/1983 | Verley | |
| 4,450,753 | A * | 5/1984 | Basrai et al. | 91/35 |
| 4,527,959 | A | 7/1985 | Whiteman | |
| 4,625,364 | A * | 12/1986 | Adams | 452/149 |
| 4,880,363 | A | 11/1989 | Holland | |
| 5,024,584 | A * | 6/1991 | Bordini et al. | 417/342 |
| 5,074,757 | A * | 12/1991 | Horn | 417/63 |
| 6,454,542 | B1 | 9/2002 | Back | |
| 7,252,148 | B2 * | 8/2007 | Traylor | 166/370 |

(Continued)

OTHER PUBLICATIONS

International Application No. PCT/US2011/037958 Search Report and Written Opinion dated Jan. 18, 2012.

*Primary Examiner* — Peter J Bertheaud
*Assistant Examiner* — Dnyanesh Kasture
(74) *Attorney, Agent, or Firm* — Conley Rose, P.C.

(57) ABSTRACT

A hydraulically driven reciprocating pump. In some embodiments, the pump includes a housing including a hydraulic chamber, a cylinder coupled to the housing, a piston assembly adapted for reciprocal motion within the housing and the cylinder, the piston assembly separating the hydraulic chamber into three subchambers, and a hydraulic system fluidicly coupled to each of the subchambers. The hydraulic system is actuatable to deliver hydraulic fluid to a first of the subchambers, whereby the piston assembly strokes back and a working fluid is drawn into the cylinder, to deliver hydraulic fluid to a second of the subchambers, whereby the piston assembly strokes out and the working fluid is exhausted from the cylinder, and to adjust a volume of hydraulic fluid within a third of the subchambers, whereby the piston assembly translates to bring a pressure of the working fluid in the cylinder to within a pre-selected range.

26 Claims, 18 Drawing Sheets

U.S. PATENT DOCUMENTS

2002/0071771 A1 6/2002 Miller
2002/0106291 A1 8/2002 Chowaniec et al.
2002/0106292 A1* 8/2002 Chowaniec et al. ..... 417/403
2009/0060687 A1 3/2009 White

* cited by examiner

HYDRAULICALLY ACTUATED RECIPROCATING PUMP

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

The disclosure relates generally to a reciprocating pump. More particularly, the disclosure relates to a hydraulically actuated reciprocating pump having a piston driven to reciprocate within a cylinder by fluid pressure. The disclosure also relates to systems and methods for reducing pressure pulsations created within the pump by reciprocation of the piston within the cylinder.

To form an oil or gas well, a bottom hole assembly (BHA), including a drill bit, is coupled to a length of drill pipe to form a drill string. The drill string is then inserted downhole, where drilling commences. During drilling, fluid, or "drilling mud," is circulated down through the drill string to lubricate and cool the drill bit, to pressurize the borehole, and to provide a vehicle for removal of drill cuttings from the borehole. After exiting the bit, the drilling fluid returns to the surface through the annulus formed between the drill string and the surrounding borehole wall. Instrumentation for taking various downhole measurements and communication devices are commonly mounted within the drill string. Many such instrumentation and communication devices operate by sending and receiving pressure pulses through the annular column of drilling fluid maintained in the borehole.

Mud pumps are commonly used to deliver drilling fluid to the drill string during drilling operations. Many conventional mud pumps are reciprocating pumps, having at least one piston-cylinder assembly driven by a crankshaft and hydraulically coupled between a suction manifold and a discharge manifold. During operation of the mud pump, the piston is mechanically drive to reciprocate within the cylinder. As the piston moves to expand the volume within the cylinder, drilling fluid is drawn from the suction manifold into the cylinder. After the piston reverses direction, the volume within the cylinder decreases and the pressure of drilling fluid contained with the cylinder increases. When the piston reaches the end of its stroke, pressurized drilling fluid is exhausted from the cylinder into the discharge manifold. While the mud pump is operational, this cycle repeats, often at a high cyclic rate, and pressurized drilling fluid is continuously fed to the drill string at a substantially constant rate.

Because the piston directly contacts drilling fluid within the cylinder, loads are transmitted from the piston to the drilling fluid. Due to the reciprocating motion of the piston, the transmitted loads are cyclic, resulting in the creation of pressure pulsations in the drilling fluid. The pressure pulsations may disturb the downhole communication devices and instrumentation by degrading the accuracy of measurements taken by the instrumentation and hampering communications between downhole devices and control systems at the surface. Over time, the pressure pulsations may also cause fatigue damage to the drill string pipe and other downhole components.

Accordingly, there is a need for an apparatus or system and associated method that reduces pressure pulsations created within fluid pressurized by a reciprocating pump due to contact between the pump piston and the fluid.

SUMMARY

A hydraulically driven pump is disclosed. In some embodiments, the pump includes a housing having a hydraulic chamber, a piston assembly separating the hydraulic chamber into at least a first subchamber and a second subchamber and disposed for reciprocal motion within the housing, and a hydraulic system fluidicly coupled with the first subchamber and the second subchamber. The hydraulic system is actuatable to deliver hydraulic fluid to the first subchamber, whereby the first subchamber is pressurized and the piston assembly translates in a first direction from a stroked back position toward a stroked out position, and to deliver hydraulic fluid to the second subchamber, whereby the second subchamber is pressurized and the piston translates in a second direction opposite the first direction from the stroked out position toward the stroked back position.

In some embodiments, the pump includes a housing including a hydraulic chamber, a cylinder coupled to the housing, a piston assembly adapted for reciprocal motion within the housing and the cylinder, the piston assembly separating the hydraulic chamber into three subchambers, and a hydraulic system fluidicly coupled to each of the subchambers. The hydraulic system is actuatable to deliver hydraulic fluid to a first of the subchambers, whereby the piston assembly strokes back and a working fluid is drawn into the cylinder, to deliver hydraulic fluid to a second of the subchambers, whereby the piston assembly strokes out and the working fluid is exhausted from the cylinder, and to adjust a volume of hydraulic fluid within a third of the subchambers, whereby the piston assembly translates to bring a pressure of the working fluid in the cylinder to within a pre-selected range.

In some embodiments, the pump includes a housing and a piston assembly disposed within the housing. The piston assembly has a piston body translatable relative to the housing and a bladder coupled between the piston body and the housing. The bladder separates a first hydraulic chamber and a second hydraulic chamber. The pump further includes a hydraulic system fluidicly coupled to the first hydraulic chamber and the second hydraulic chamber. The hydraulic system is actuatable to deliver hydraulic fluid to the first hydraulic chamber, whereby the bladder flexes and the piston body translates in a first direction, and to deliver hydraulic fluid to the second hydraulic chamber, whereby the bladder flexes and the piston body translates in a second direction opposite the first direction.

Thus, embodiments described herein comprise a combination of features and characteristics intended to address various shortcomings associated with conventional mechanically driven reciprocating pumps. The various characteristics described above, as well as other features, will be readily apparent to those skilled in the art upon reading the following detailed description of the preferred embodiments, and by referring to the accompanying drawings.

BRIEF DESCRIPTION OF THE DRAWINGS

For a detailed description of the disclosed embodiments, reference will now be made to the accompanying drawings in which.

DETAILED DESCRIPTION OF THE DISCLOSED EMBODIMENTS

Figure 1:
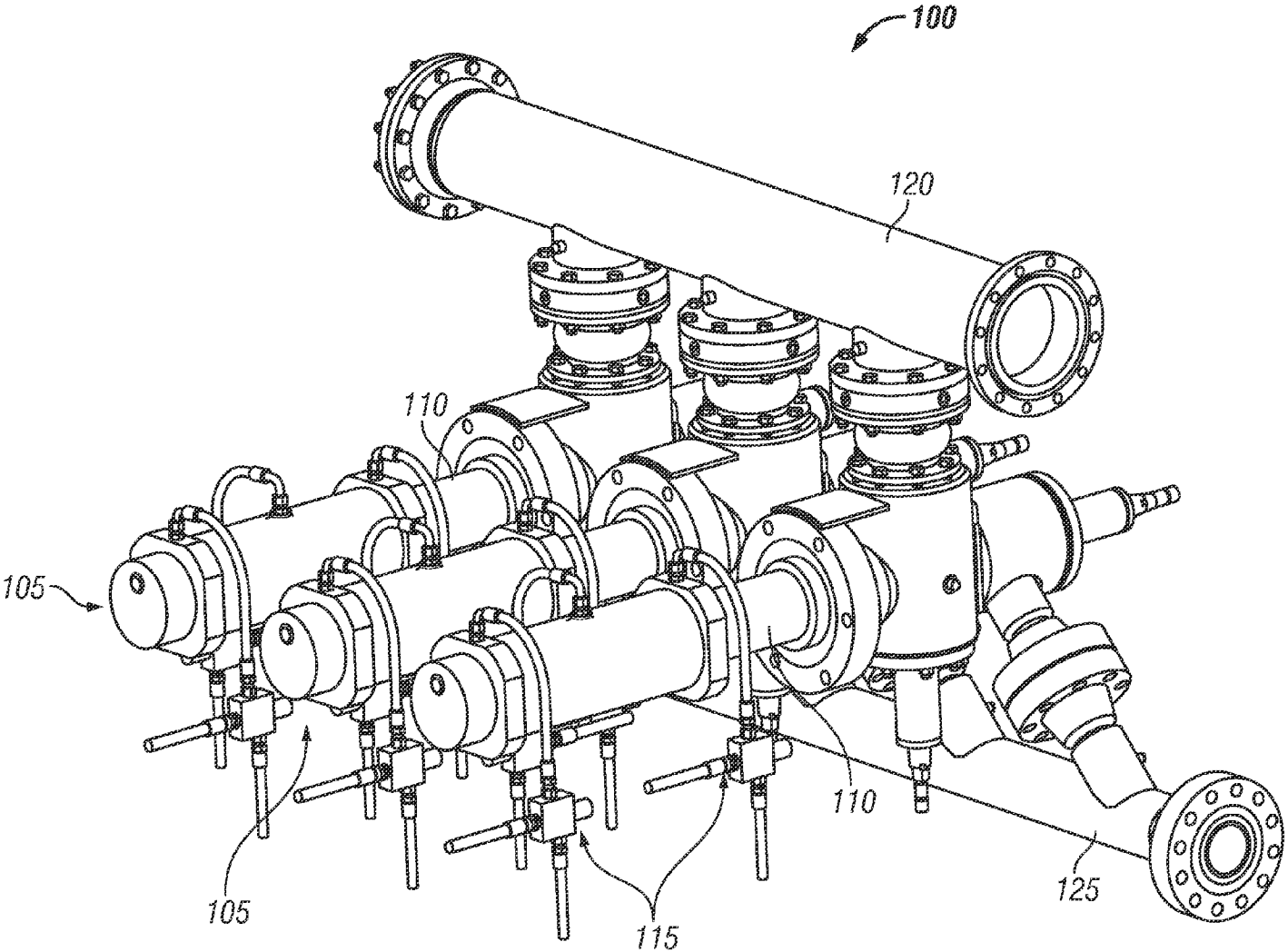
FIG. 1 is a perspective view of a hydraulically driven reciprocating pump in accordance with the principles disclosed herein.

The following description is directed to exemplary embodiments of a hydraulically driven reciprocating pump system. The embodiments disclosed should not be interpreted, or otherwise used, as limiting the scope of the disclosure, including the claims. One skilled in the art will understand that the following description has broad application, and that the discussion is meant only to be exemplary of the described embodiments, and not intended to suggest that the scope of the disclosure, including the claims, is limited only to those embodiments. For example, the pump described herein may be employed in any fluid conveyance system where it is desirable to reduce the turbulence of fluid contained within or moving through the system.

Certain terms are used throughout the following description and the claims to refer to particular features or components. As one skilled in the art will appreciate, different persons may refer to the same feature or component by different names. This document does not intend to distinguish between components or features that differ in name but not function. Moreover, the drawing figures are not necessarily to scale. Certain features and components described herein may be shown exaggerated in scale or in somewhat schematic form, and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, the connection between the first device and the second device may be through a direct connection, or through an indirect connection via other intermediate devices and connections. Further, the terms "axial" and "axially" generally mean along or parallel to a central or longitudinal axis. The terms "radial" and "radially" generally mean perpendicular to the central or longitudinal axis, while the terms "circumferential" and "circumferentially" generally mean disposed about the circumference, and as such, perpendicular to both the central or longitudinal axis and a radial axis normal to the central longitudinal axis. As used herein, these terms are consistent with their commonly understood meanings with regard to a cylindrical coordinate system.

Referring now to FIG. 1, there is shown a hydraulically driven reciprocating pump 100 for pressurizing a working fluid, such as but not limited to drilling mud. Reciprocating pump 100 includes three substantially identical piston-cylinder assemblies 105. Each piston-cylinder assembly 105 includes a piston assembly (not visible in FIG. 1, but identified in FIG. 2 by reference number 145) translatably disposed within a cylinder 110, meaning the piston assembly is translatable within and relative to cylinder 110. The piston assemblies are driven out of phase with each other, meaning the position of each relative to its associated cylinder 110 is different than that of the other piston assemblies at any given instant. In certain embodiments, piston-cylinder assemblies 105 are operated 120 degrees out of phase with each other. Even so, other phase relationships may also be employed. As will be described, the piston assemblies are driven by a hydraulic system 115 that is, in turn, governed by a control system. For simplicity, hydraulic system 115 is only partially depicted in FIG. 1 whereas the control system is not shown at all. These systems are, however, shown in other figures of this disclosure and described below.

Figure 2:
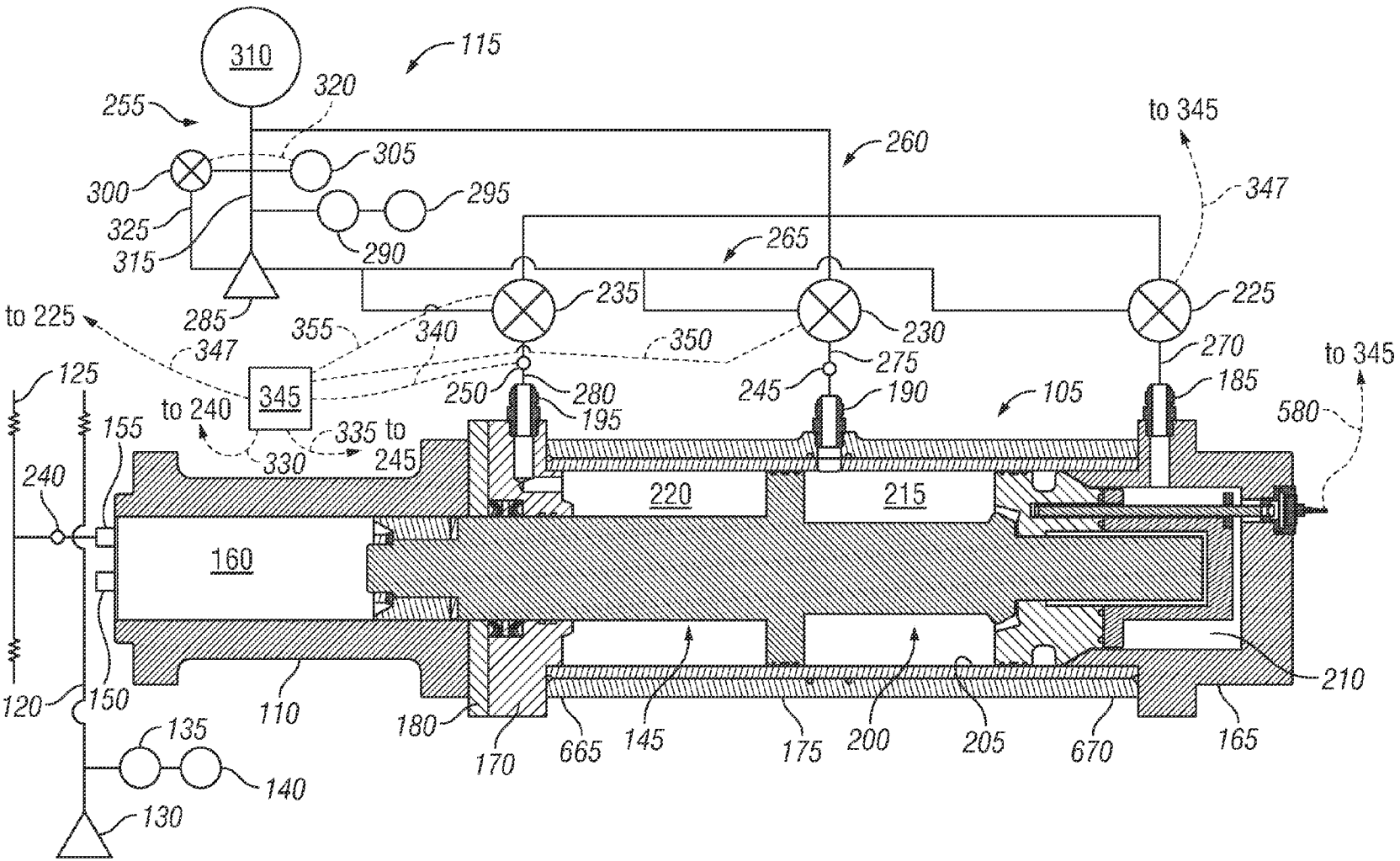
FIG. 2 is a cross-sectional view of one piston-cylinder assembly of FIG. 1 fluidicly coupled with the hydraulic system and electrically coupled the control system, the hydraulic system and the control system both schematically represented.

Each piston-cylinder assembly 105 is coupled between a suction manifold 120 and a discharge manifold 125. Referring to FIG. 2, which, for simplicity, illustrates only one piston-cylinder assembly 105, drilling mud is delivered from a source 130 via a pump 135 driven by a motor 140 through suction manifold 120 to cylinder 110. As piston assembly 145 is stroked back within cylinder 110, meaning translated within cylinder 110 to the right as viewed in FIG. 2, drilling mud is drawn through a suction valve 150 into a compression chamber 160 within cylinder 110. After piston assembly 145 reverses direction and begins to translate within cylinder 110 to the left as viewed in FIG. 2, or stroke out, drilling mud contained within compression chamber 160 is pressurized by piston assembly 145. As piston assembly 145 approaches the end of its stroke, the pressurized drilling mud is exhausted from cylinder 110 through a discharge valve 155 into discharge manifold 125. Thus, as piston assembly 145 reciprocates within cylinder 110, piston-cylinder 105 repeatedly receives drilling mud from suction manifold 120, pressurizes the drilling mud received, and delivers the pressurized drilling mud to discharge manifold 125.

Piston-cylinder assembly 105 further includes a two flanges 165, 170, a composite housing 175 disposed therebetween, and a circular plate 180. Cylinder 110 is coupled to flange 170 with plate 180 disposed therebetween. Circular plate 180 is a cover plate for sealing elements disposed along the bore of flange 170, as shown in FIG. 2 and discussed further below. Flanges 165, 170 and composite housing 175 form a hydraulic chamber 200. Also, each of flange 165, composite housing 175, and flange 170 have a hydraulic fluid port 185, 190, 195, respectively, fluidicly coupled, meaning in fluid communication, with hydraulic chamber 200.

Piston assembly 145 is disposed within hydraulic chamber 200 and compression chamber 160 of cylinder 110, and reciprocates within chambers 160, 200 to draw drilling fluid into compression chamber 160, pressurize the drilling fluid, and exhaust the pressurized drilling fluid from compression chamber 160, as previously described. Piston-cylinder assembly 105 further includes a stepped piston 365 and a piston cover 370 disposed within hydraulic chamber 200 between piston assembly 145 and flange 165. Stepped piston 365 and piston cover 370 are rigidly coupled such that there is no relative movement between the two. Further, stepped piston 365 and piston cover 370 coupled thereto are axially translatable relative to piston assembly 145 within composite housing 175.

Each of piston assembly 145 and stepped piston 365 sealingly engages the inner surface 205 of composite housing 175. Thus, hydraulic chamber 200 is divided by piston assembly 145 and stepped piston 365 into three subchambers 210, 215, 220. Subchamber 210 is disposed between stepped piston 365 and flange 165. Subchamber 220 is disposed adjacent flange 170, and subchamber 215 is disposed between subchambers 210, 220. Hydraulic fluid ports 185, 190, 195 are fluidicly coupled with subchambers 210, 215, 220, respectively.

Hydraulic system 115 drives piston assembly 145, meaning hydraulic system 115 causes piston assembly 145 to reciprocate. Hydraulic system 115 includes three valves 225, 230, 235, three pressure sensors 240, 245, 250, a hydraulic fluid supply unit 255, a hydraulic fluid supply piping network 260, a hydraulic fluid return piping network 265, and three flowlines or jumpers 270, 275, 280. Valves 225, 230, 235 are fluidicly coupled to ports 185, 190, 195, respectively, via flowlines 270, 275, 280. Valves 225, 230, 235 are also fluidicly coupled to hydraulic fluid supply unit 255 via supply piping network 260 and return piping network 265. In the illustrated embodiment of FIG. 2, valves 225, 230, 235 are electro-proportional reducing/relieving pressure control valves, such as those having model number EHPR98-T38 and manufactured by HydraForce, Inc., headquartered at 500 Barclay Blvd., Lincolnshire, Ill. 60069. In certain embodiments, the valve 225 (and also the valve 230 and the valve 235) is a valve system or composite valve. For example, the valve system 225 can include a pneumatic or hydraulically actuated valve via a solenoid or electrically driven pilot valve, as is known in the industry. In another example, the valve system 225 can include other valves as disclosed herein such as the valve 230, the valve 235, a relief valve 300 (discussed below), the valve 150, the valve 155, or a combination thereof. Also, sensors 240, 245, 250 are high pressure sensors, such those having model number P5000-500-1G3S and manufactured by Kavlico, Inc., headquartered at 14501 Princeton Avenue, Moorpark, Calif. 93021.

Hydraulic fluid supply unit 255 includes a hydraulic fluid source 285, a pump 290 driven by a motor 295, a relief valve 300 and gauge 305, and an accumulator 310, all fluidicly coupled. When motor 295 is operating, source pump 290 delivers hydraulic fluid from source 285 through a flowline 315 to supply piping network 260. Supply piping network 260, in turn, conveys the hydraulic fluid to valves 225, 230, 235, which are operable, as will be described, to allow the hydraulic fluid to pass through flowlines 270, 275, 280 and ports 185, 195, 190 to subchambers 210, 215, 220, respectively, of piston-cylinder assembly 105. Valves 225, 230, 235 are also operable to relieve hydraulic fluid from subchambers 210, 220, 215, respectively. Hydraulic fluid relieved from subchambers 210, 215, 220 is returned through return piping network 265 to hydraulic fluid source 285.

Gauge 305 is operable to sense the pressure of hydraulic fluid provided by source 285 to flowline 315. The sensed pressure is then communicated to relief valve 300 by an electrical conductor 320. For clarity, all electrical conductors, including line 320, shown in the figures are represented by dashed lines, whereas all flowlines, piping networks, or manifolds through which hydraulic fluid and drilling mud flows are represented by solid lines. Referring still to FIG. 2, if the pressure sensed by gauge 305 exceeds a pre-selected pressure setting, relief valve 300 is actuated to divert hydraulic fluid from flowline 315 into a bypass flowline 325. The diverted hydraulic fluid is then returned to hydraulic fluid source 285. Diverting hydraulic fluid from flowline 315 into bypass flowline 325 in this manner prevents overpressuring of supply piping network 260 and other components of hydraulic system 115 downstream of network 260 beyond the pre-selected pressure setting.

Pressure sensor 245 is disposed on flowline 275 proximate port 190. Sensor 245 is operable to sense the pressure of hydraulic fluid in flowline 275, and thus subchamber 215. Similarly, pressure sensor 250 is disposed on flowline 280 proximate port 195. Sensor 250 is operable to sense the pressure of hydraulic fluid in flowline 280, and thus subchamber 220. Pressure sensor 240 is disposed downstream of discharge valve 155 of piston-cylinder assembly 105. Sensor 240 is operable to sense the pressure of drilling mud exhausted from piston-cylinder assembly 105.

Pump 100 further includes a control system 345. Control system 345 is electrically coupled to PPC valves 225, 230, 235 via electrical conductors 347, 350, 355, respectively, and to pressure sensors 240, 245, 250 via electrical conductors 330, 335, 340, respectively. As will be described, control system 345 governs the opening and closing of valves 230, 235 dependent upon pressures sensed by sensors 240, 245, 250 to supply hydraulic fluid in an alternating fashion to subchamber 215 while relieving hydraulic fluid from subchamber 220 and to subchamber 220 while relieving hydraulic fluid from subchamber 215. When subchamber 215 is supplied with hydraulic fluid, or pressurized, subchamber 220 is relieved of hydraulic fluid, or de-pressurized, and vice versa. Cyclic pressurization of subchambers 215, 220 and substantially simultaneous depressurization of chambers 220, 215 enables piston assembly 145 to be driven by fluid pressure. When subchamber 215 is pressurized, piston assembly 145 strokes out, moving from right to left as viewed in FIG. 2 and pushing hydraulic fluid from subchamber 220 through port 195. When subchamber 220 is subsequently pressurized, piston assembly 145 strokes back, moving from left to right as viewed in FIG. 2 and pushing hydraulic fluid from subchamber 215 through port 190. At the same time, control system 345 governs the opening and closing of valve 225 to adjust the volume of hydraulic fluid in subchamber 210 to maintain the discharge pressure of pump 100 substantially constant, or within a range.

Figure 3:
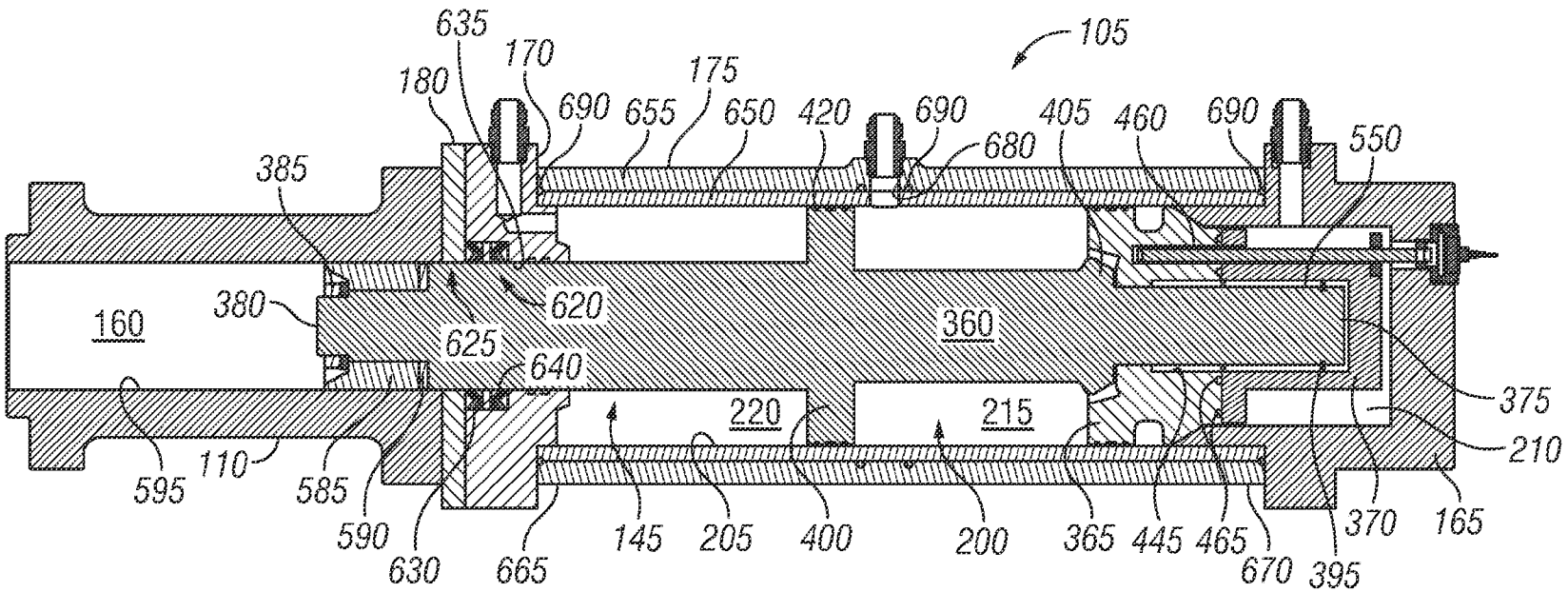
FIG. 3 is a cross-sectional, lengthwise view of the piston-cylinder assembly of FIG. 2.
Figure 4:
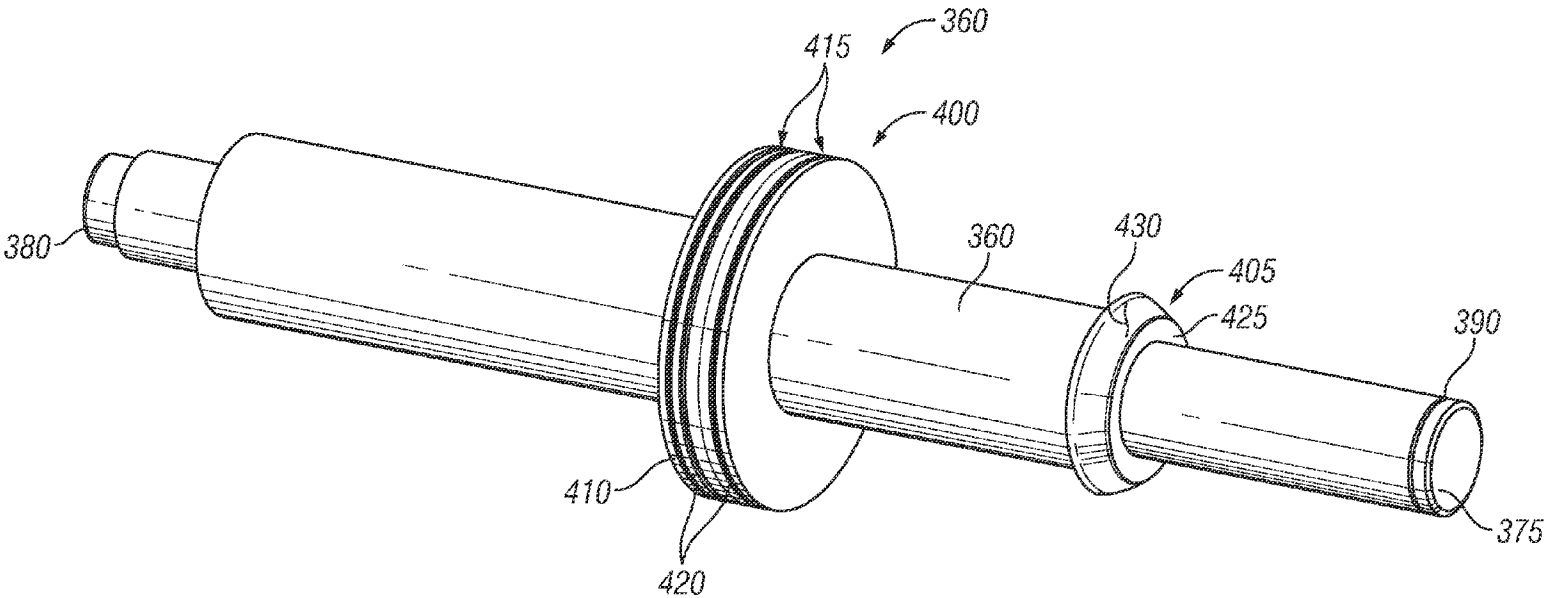
FIG. 4 is a perspective view of the body of the piston assembly of FIG. 3.
Figure 6:
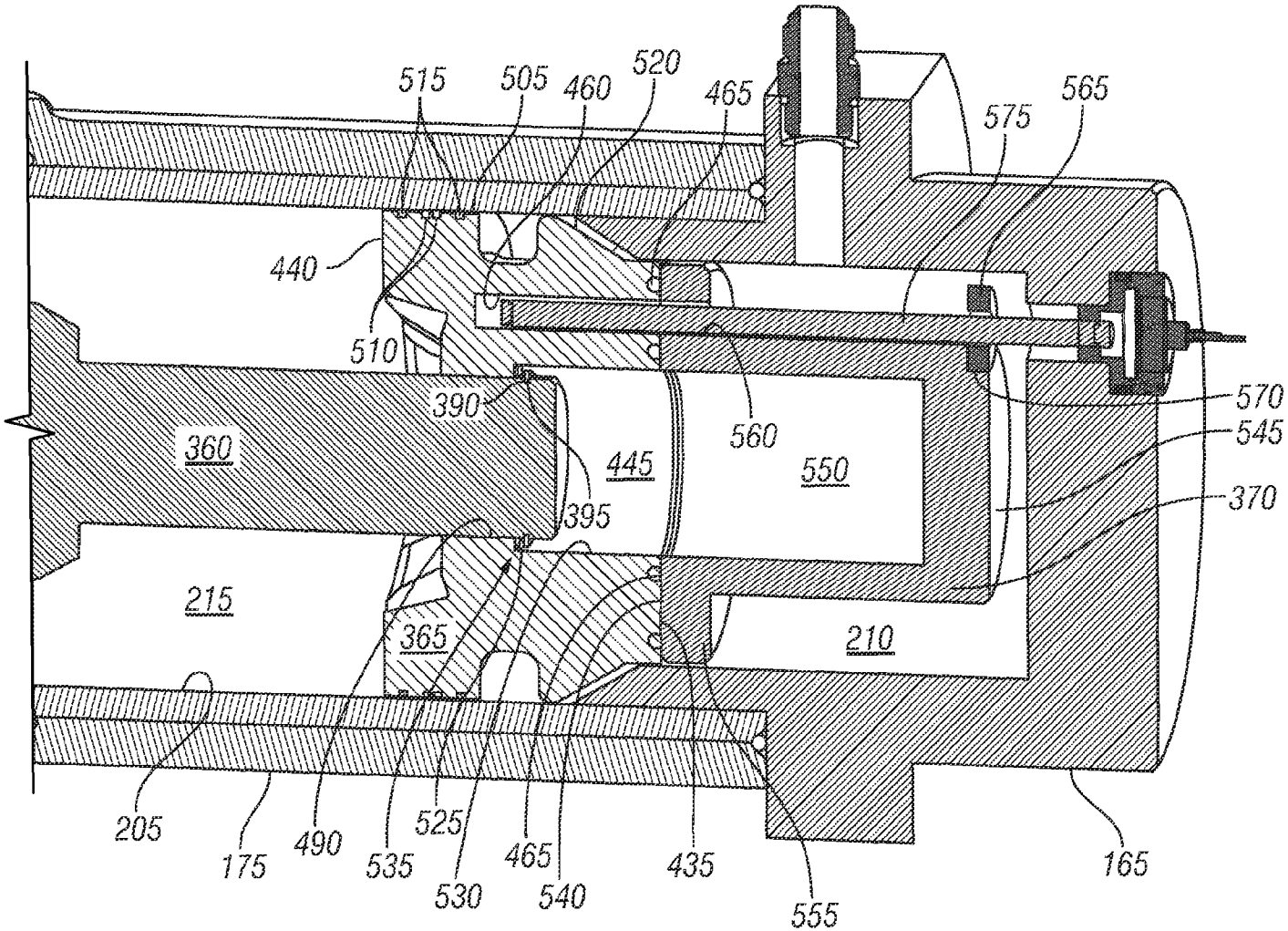
FIG. 6 is an enlarged, cross-sectional view of the piston-cylinder assembly of FIG. 3, better illustrating the stepped piston, piston cover, and linear displacement transducer.

Turning to FIG. 3, piston assembly 145 includes an axially extending body 360. Body 360 is a generally cylindrical member with two opposing ends 375, 380. Ends 375, 380 of body 360 have reduced diameters, meaning each has a diameter that is smaller than that of the remainder of body 360 extending therebetween. As will be described further below, body 360 receives a coupling 385 disposed about reduced diameter end 380. Referring now to FIG. 4, body 360 further includes a groove 390 extending circumferentially thereabout at end 375. An annular disc or ring 395 (not shown in FIG. 4 but shown in FIGS. 3 and 6) is seated in groove 390. Disc 395 prevents body 360 from disengaging stepped piston 365 when body 360 strokes out during operation of pump 100, as illustrated by FIG. 6.

Body 360 further includes a radially extending piston 400 and a radially extending flange 405. Piston 400 has an axially extending outer surface 410 defined by a substantially constant or uniform diameter. Uniform piston 400 includes a plurality of circumferentially extending grooves 415 formed in surface 410. A sealing element 420 is disposed within each groove 415. In some embodiments, sealing elements 420 are O-rings. Elements 420 enable sealing engagement between uniform piston 400 and inner surface 205 of composite housing 175, as illustrated by FIG. 3, thereby limiting or preventing the transfer of hydraulic fluid between subchambers 215, 220.

Referring to FIGS. 3 and 4, flange 405 has a radially extending annular surface 425 and an angled or frustoconical outer surface 430 extending therefrom. Surface 430 is defined by a diameter that increases in the axial direction moving away from surface 425. The angular nature of surface 430 enables gradual or increasing engagement between flange 405 and hydraulic fluid in subchamber 215 (FIG. 3) as body 360 strokes back and the displacement of hydraulic fluid from the bores of stepped piston 365 and piston cover 370, to be described further below, as end 375 of body 360 is received therein. This minimizes, even eliminates, the application of a blunt load to body 360 due to engagement with the hydraulic fluid that may otherwise occur were surface 430 not frustoconical. Such blunt interaction between the hydraulic fluid and body 360 may create undesirable pressure fluctuations in the drilling mud within cylinder 110 and/or pressure fluctuations in the hydraulic fluid that may damage components of hydraulic system 115.

Figure 5A:
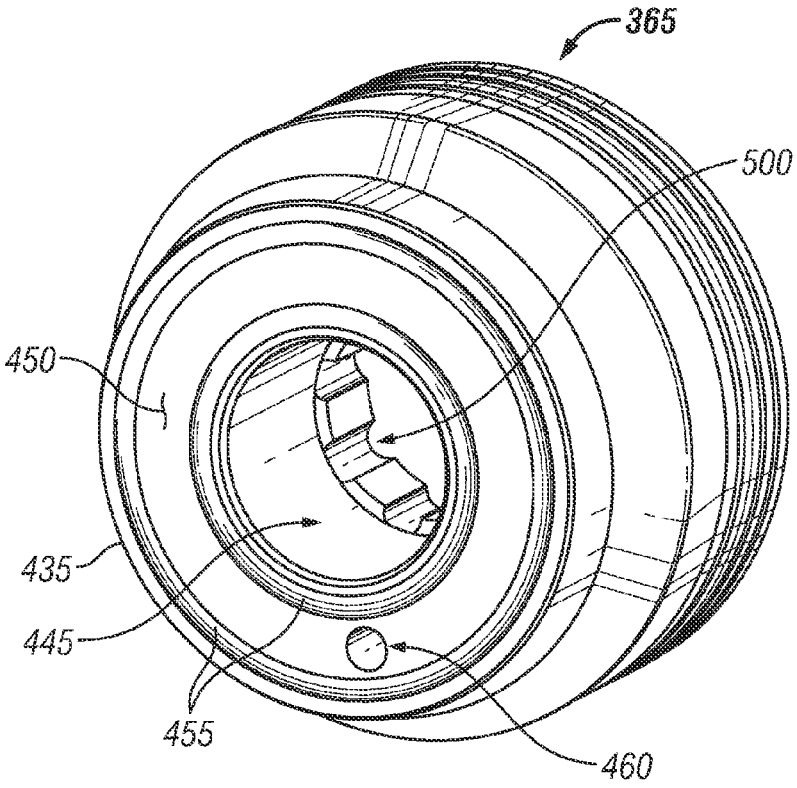
FIGS. 5A and 5B are opposing perspective end views of the stepped piston of FIG. 3.
Figure 5B:
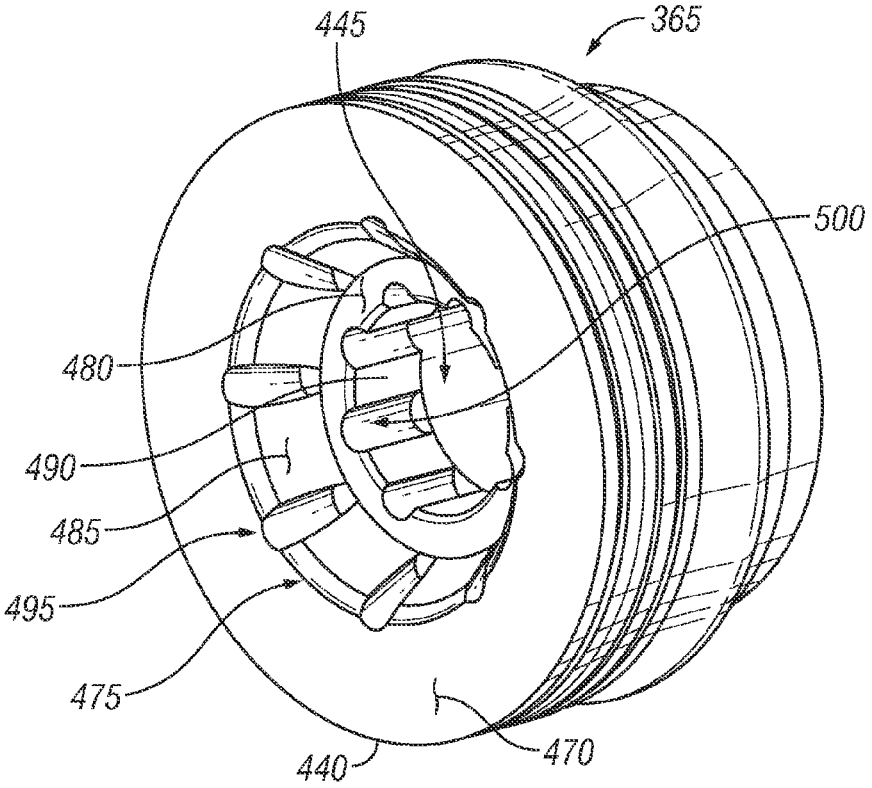

Referring now to FIGS. 5A and 5B, stepped piston 365 is an annular member with two opposing ends 435, 440 and a bore 445 extending therethrough. At end 435, best viewed in FIG. 5A, stepped piston 365 has a radially extending surface 450 with two circumferentially extending grooves 455 and an axially extending bore 460 (see also FIG. 3) formed therein. A sealing element 465 (not shown in FIG. 5A, but visible in FIGS. 3 and 6) is disposed within each groove 455. In some embodiments, sealing elements 465 are O-rings. Elements 465 enable sealing engagement between stepped piston 365 and piston cover 370, thereby limiting or preventing the transfer of hydraulic fluid between subchambers 210, 215.

At end 440, best viewed in FIG. 5B, stepped piston 365 has a radially extending surface 470 and a recess 475 formed therein. Recess 475 is bounded at its base by a radially extending surface 480 and along its side by a substantially axially extending surface 485. Recess 475 is configured to receive flange 405 (FIG. 3) therein such that surface 425 of flange 405 abuts surface 480. Stepped piston 365 further includes a substantially axially extending surface 490 extending from surface 480 and bounding bore 445. A plurality of circumferentially spaced grooves 495, 500 are formed in surfaces 485, 490, respectively.

Referring to FIG. 6, stepped piston 365 has a radially facing, circumferential outer surface 505 proximate end 440. Surface 505 is defined by a substantially constant diameter. Stepped piston 365 includes a plurality of circumferentially extending grooves 510 formed in surface 505. A sealing element 515 is disposed within each groove 510. In some embodiments, sealing elements 515 are O-rings. Elements 515 enable sealing engagement between stepped piston 365 and inner surface 205 of composite housing 175, thereby limiting or preventing the transfer of hydraulic fluid between sub chambers 210, 215.

Stepped piston 365 also has an angled or frustoconical outer surface 520. Surface 520 is defined by a diameter that increases moving in the axial direction away from end 435 of stepped piston 365. The angular nature of surface 520 enables gradual or increasing engagement between stepped piston 365 and hydraulic fluid in subchamber 210 as stepped piston 365 strokes back. This minimizes the application of a blunt load to stepped piston 365 due to engagement with the hydraulic fluid that may otherwise occur were surface 520 not frustoconical.

Bounding bore 445, stepped piston 365 has a radially extending surface 525 extending from surface 490 and an axially extending surface 530 extending from surface 525. Surface 530 is defined by a diameter exceeding that defining surface 490. Thus, a stop or shoulder 535 is formed at the intersection of surfaces 525, 530 within stepped piston 365. Shoulder 535 limits axial translation of body 360 relative to stepped piston 365. When body 360 strokes out relative to stepped piston 365, engagement between disc 395 seated in groove 390 of body 360 and shoulder 535 of stepped piston 365 prevents body 360 from disengaging stepped piston 365.

Referring still to FIG. 6, piston cover 370 is an annular member having two opposing ends 540, 545 and a bore 550. At end 540, piston cover 370 has a radially extending flange 555. Flange 555 enables coupling of piston cover 370 to end 435 of stepped piston 365. As previously described, elements 465 enable sealing engagement between piston cover 370 and stepped piston 365, limiting or preventing the exchange of hydraulic fluid between subchambers 210, 215. Bore 550 extends from end 540 of piston cover 370 and is substantially aligned with bore 445 of stepped piston 365. Alignment of bores 445, 550 enables end 375 of body 360 to be inserted through bore 445 of stepped piston 365 into bore 550 of piston cover 370. End 545 of piston cover 370 is closed. Due to the sealing engagement of stepped piston 365 with inner surface 205 of composite housing 175, the sealing engagement between stepped piston 365 and piston cover 370, and the closed end 545 of piston cover 370, together stepped piston 365 and piston cover 370 form a barrier that fluidicly isolates subchamber 210 from subchamber 215, and vice versa.

Piston cover 370 further includes an axially extending bore 560 and a recess 570 formed at end 545 of piston cover 370. Bore 560 extends through flange 555 and aligns with bore 460 of stepped piston 365. Support ring 565 is seated in a recess 570 formed at end 545 of piston cover 370 and coupled thereto. Piston-cylinder assembly 105 further includes a linear displacement transducer 575 and a magnetic marker 565. Linear displacement transducer 575 is coupled to flange 165 and extending through subchamber 210 and magnetic marker 565 into aligned bores 460, 560. Linear displacement transducer 575 is electrically coupled with control system 345

(FIG. 2) via an electrical conductor 580 (FIG. 2). Magnetic marker 565 produces a magnetic field thereabout, as does linear displacement transducer 575. Interaction between the two magnetic fields causes linear displacement transducer 575 to deform. Electronic signals generated by linear displacement transducer 575 in response to its deformation and delivered from linear displacement transducer 575 to control system 345 enable control system 345 to determine the axial position of marker 565, and thus stepped piston 365, relative to flange 165 and, in turn, the volume of subchamber 210 during operation of pump 100. In the illustrated embodiment, transducer 575 may be one of those manufactured by Novotechnik U.S., Inc., headquartered at 155 Northboro Road, Southborough, Mass. 01772, such as transducers having model number TIM 0200 302 821 201. Alternatively, transducer 575 may be manufactured by MTS Systems Corporation, headquartered at 14000 Technology Drive, Eden Prairie, Minn. 55344, and having model number GT2S 200M D60 1A0.

Referring again to FIG. 3, piston assembly 145 is axially translatable relative to stepped piston 365 and piston cover 370 coupled thereto, as previously described. When piston assembly 145 strokes back, end 375 of body 360 is inserted through bore 445 of stepped piston 365 and received within bore 550 of piston cover 370, as shown. Hydraulic fluid contained within bore 445 of stepped piston 365 and bore 550 of piston cover 370 is displaced therefrom through grooves 495, 500 (FIG. 5B) into subchamber 215. Thus, hydraulic fluid within bores 445, 550 does not remain trapped between flange 405 of body 360, stepped piston 365, and cover piston 370, exerting a force that resists translation of piston assembly 145.

Figure 7:
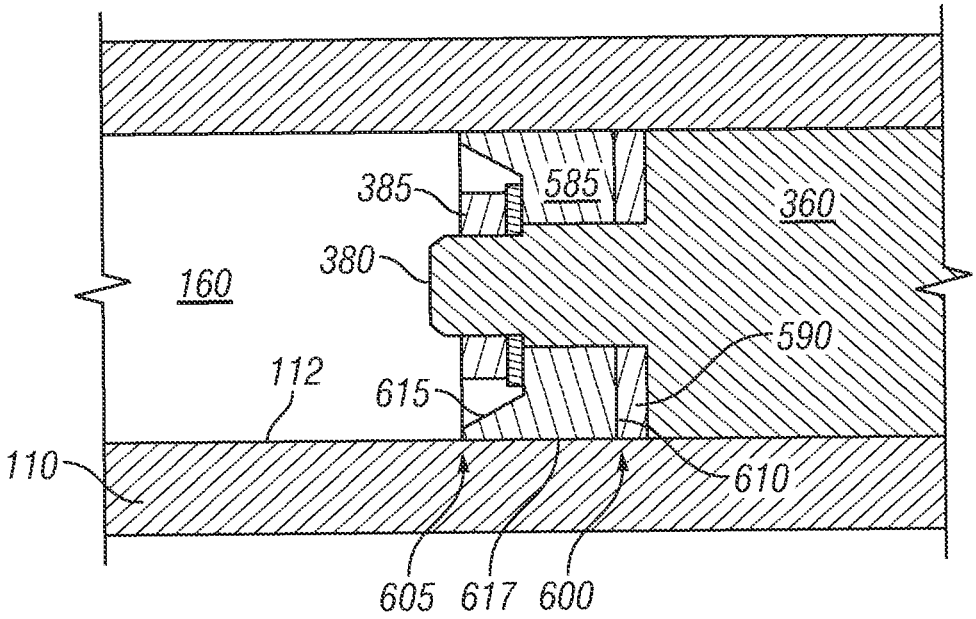
FIG. 7 is an enlarged, cross-sectional view of the opposite end of the piston-cylinder assembly of FIG. 3, better illustrating the piston seal and backup seal.

Piston-cylinder assembly 105 further includes a piston seal 585 and a backup seal 590 disposed about recessed end 380 of piston assembly 145 translatably received within cylinder 110 and secured thereto by coupling 385. Seal 585 sealingly engages the inner surface 595 of cylinder 110 to prevent the loss of pressurized drilling mud from compression chamber 160 along these interfaces. Backup seal 590 rigidly supports piston seal 585. As best viewed in FIG. 7, backup seal 590 is annular or ring-shaped, similar to a washer. Piston seal 585 is also annular and has two opposing ends 600, 605. End 600 has a planar, radially extending surface 610 engaging backup seal 590. End 605 has a generally concave surface 615 facing compression chamber 160. The concave shape of surface 615 enables sealing engagement between piston seal 585 and cylinder 110. The pressure of drilling mud within cylinder 110 acts against surface 615, forcing the outer surface 617 of piston seal 585 into engagement with the inner surface 112 of cylinder 110.

Referring again to FIG. 3, piston assembly 145 extends through aligned bores 620, 625 in flange 170 and circular plate 180, respectively, between compression chamber 160 of cylinder 110 and hydraulic chamber 200 within composite housing 175. One or more grooves 630 are formed along the inner surface 635 of flange 170 bounding bore 620. A sealing element 640 is disposed within each groove 630. In some embodiments, sealing elements 640 are O-rings. Elements 640 enable sealing engagement between flange 170 and piston assembly 145, limiting or preventing the loss of hydraulic fluid from subchamber 220 at this interface.

Figure 8:
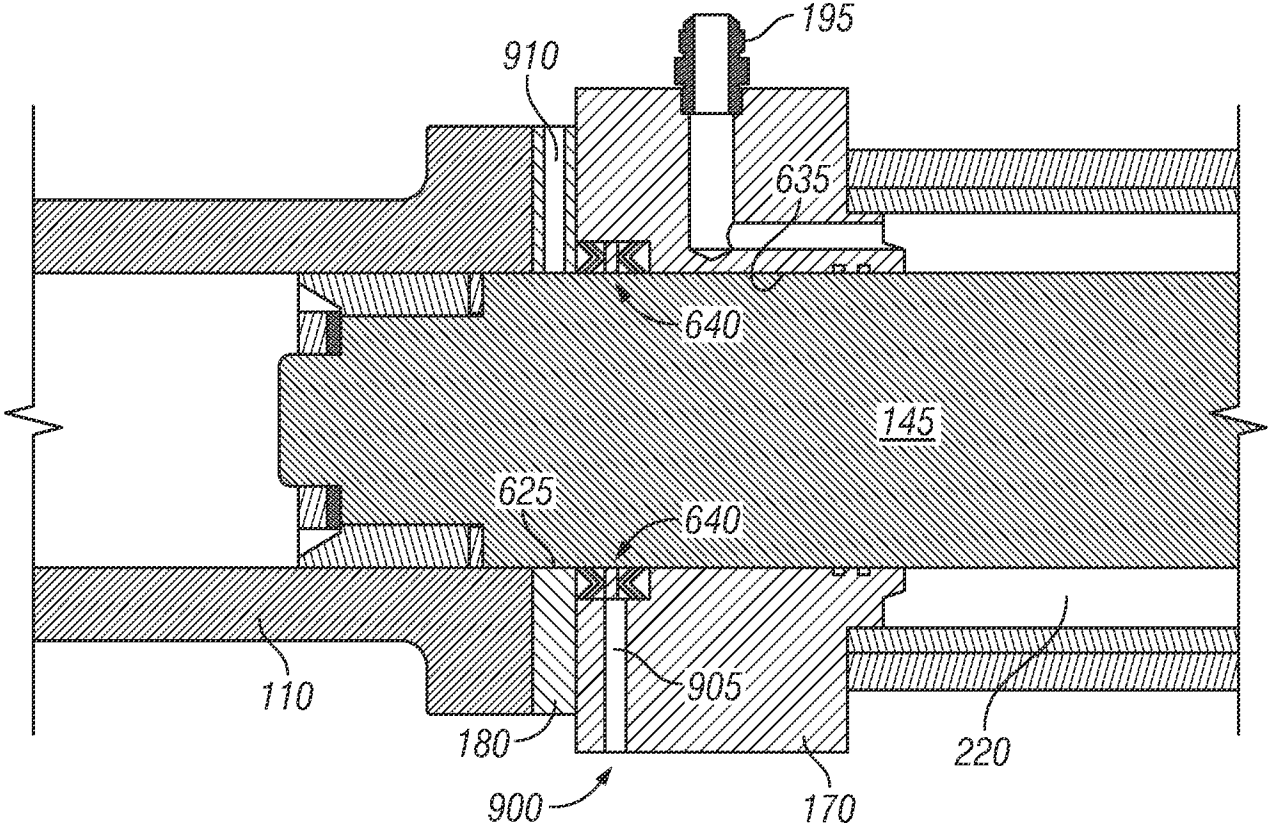
FIG. 8 is an enlarged, cross-sectional view of the piston-cylinder assembly of FIG. 3, illustrating an optional seal lubrication system.

To increase the life of sealing elements 640, pump 100 may optionally include a seal lubrication system 900, illustrated in FIG. 8. As shown, lubrication system 900 includes a lubrication fluid inlet port 905 and a lubrication fluid outlet port 910. Inlet port 905 extends radially between the outer surface of flange 170 and inner surface 635 of flange 170 proximate sealing elements 640. Outlet port 910 extends radially between the outer surface of circular plate 180 and bore 625 of plate 180. During operation of pump 100, a lubricating fluid or lubricant may be injected into port 905 to lubricate sealing elements 640. The injected lubricant flows from pump 100 through outlet port 910. Flushing sealing elements 640 with lubricant in this manner reduces wear to sealing elements 640 from friction and removes dirt and other particulates which may otherwise cause wear and abrasion to sealing elements 640 as piston assembly 145 reciprocates.

Figure 9:
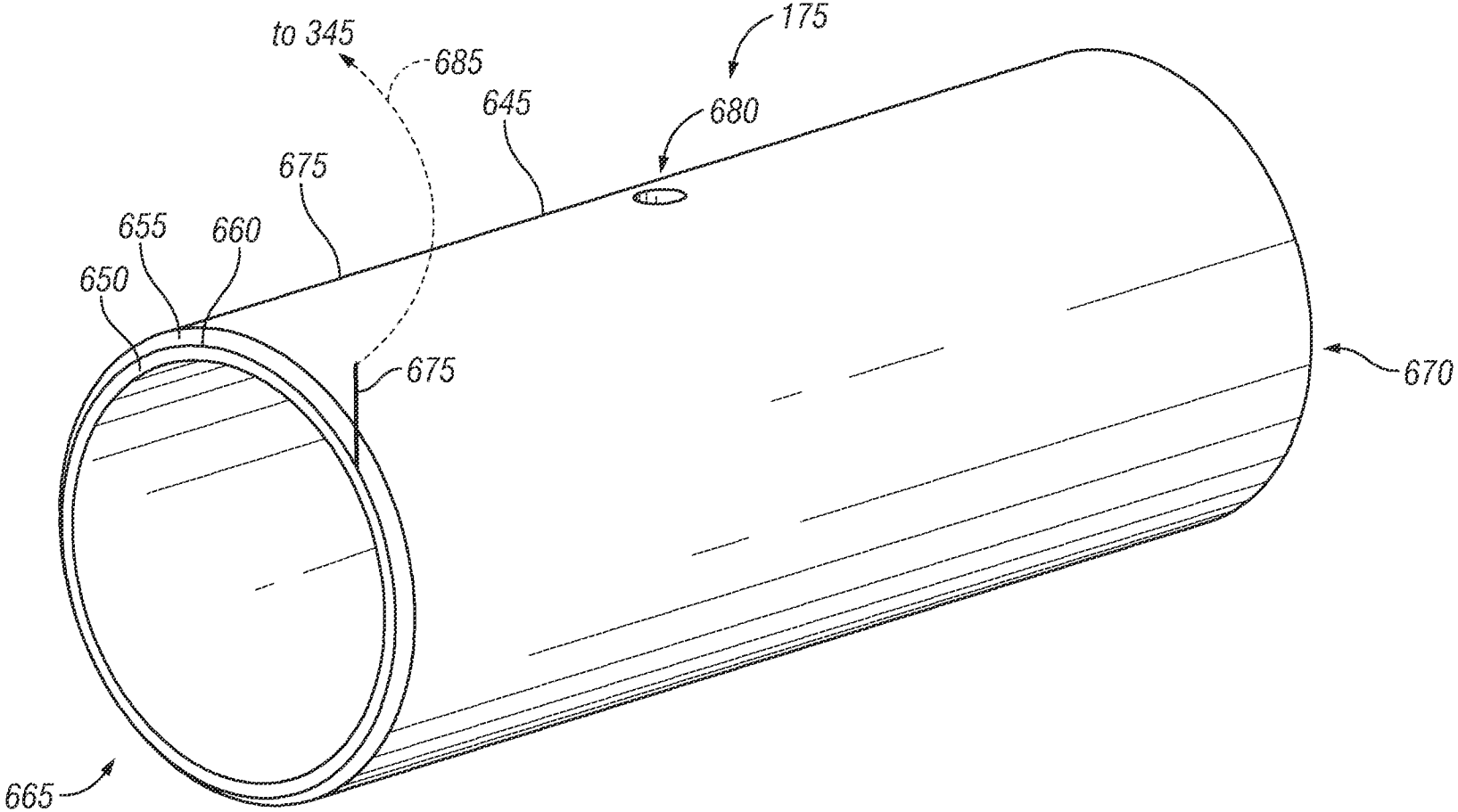
FIG. 9 is a perspective view of the composite housing of the piston-cylinder assembly of FIG. 3.

Referring to FIG. 9, composite housing 175 is a generally tubular member 645 formed by two concentric layers 650, 655 with an electrically resistive coil 660 embedded therebetween. Tubular member 645 is manufactured by Polygon Company, headquartered at 103 Industrial Park Drive, Walkerton, Ind. 46574, and referred to as the POLYSLIDE IST Smart Cylinder. Tubular member 645 has two opposing ends 665, 670, an electrical wire 675 extending radially from embedded coil 660 proximate end 665, and a bore 680 extending therethrough. In some embodiments, outer layer 655 comprises steel, and inner layer 650 is a composite liner. In other embodiments, the coil may be embedded directly into the inner layer, rather than exist as a separate component which is disposed between the concentric layers as illustrated. Bore 680 enables fluid communication between hydraulic fluid port 190 (FIG. 2) and subchamber 215 (FIG. 2), as previously described.

Wire 675 is electrically coupled between resistive coil 660 and control system 345 (FIG. 2) via an electrical conductor 685 extending therebetween. When piston assembly 145 translates within piston-cylinder assembly 105, as illustrated by FIG. 2, uniform piston 400 of piston assembly 145 engages inner surface 205 of composite housing 175, causing a localized pressure load on coil 660 and a change in the resistance of coil 660 in the region of compression. Control system 345 is operable to determine the axial position of uniform piston 400 within composite housing 175 relative to stepped piston 365 and to cylinder 110 using a signal from coil 660 delivered to control system 345 via wire 675 and electrical conductor 685 indicative of the localized change in the resistance of coil 660. Using the axial position of uniform piston 400 and the axial position of stepped piston 365, determined as previously described, control system 345 is also operable to determine the volumes of subchambers 215, 220.

As an alternative to resistive coil 660, piston-cylinder assembly 105 may comprise a linear displacement transducer and magnetic marker coupled to uniform piston 400, similar to transducer 575 and marker 565 coupled to piston cover 370. In such embodiments, the linear displacement transducer is operable to deliver electrical signals to control system 345. Using signals from the linear displacement transducer, control system 345 determines the axial position of uniform piston 400 and the volumes of subchambers 215, 220.

Returning to FIG. 3, composite housing 175 further includes a plurality of sealing elements 690 disposed between outer and inner layers 650, 655 proximate ends 665, 670 and around bore 680. Elements 690 prevent the seepage of hydraulic fluid between concentric layers 650, 655 which may otherwise tend to cause separation of layers 650, 655, damage to coil 660 (FIG. 9), and/or degradation of the coil's performance.

Figure 10:
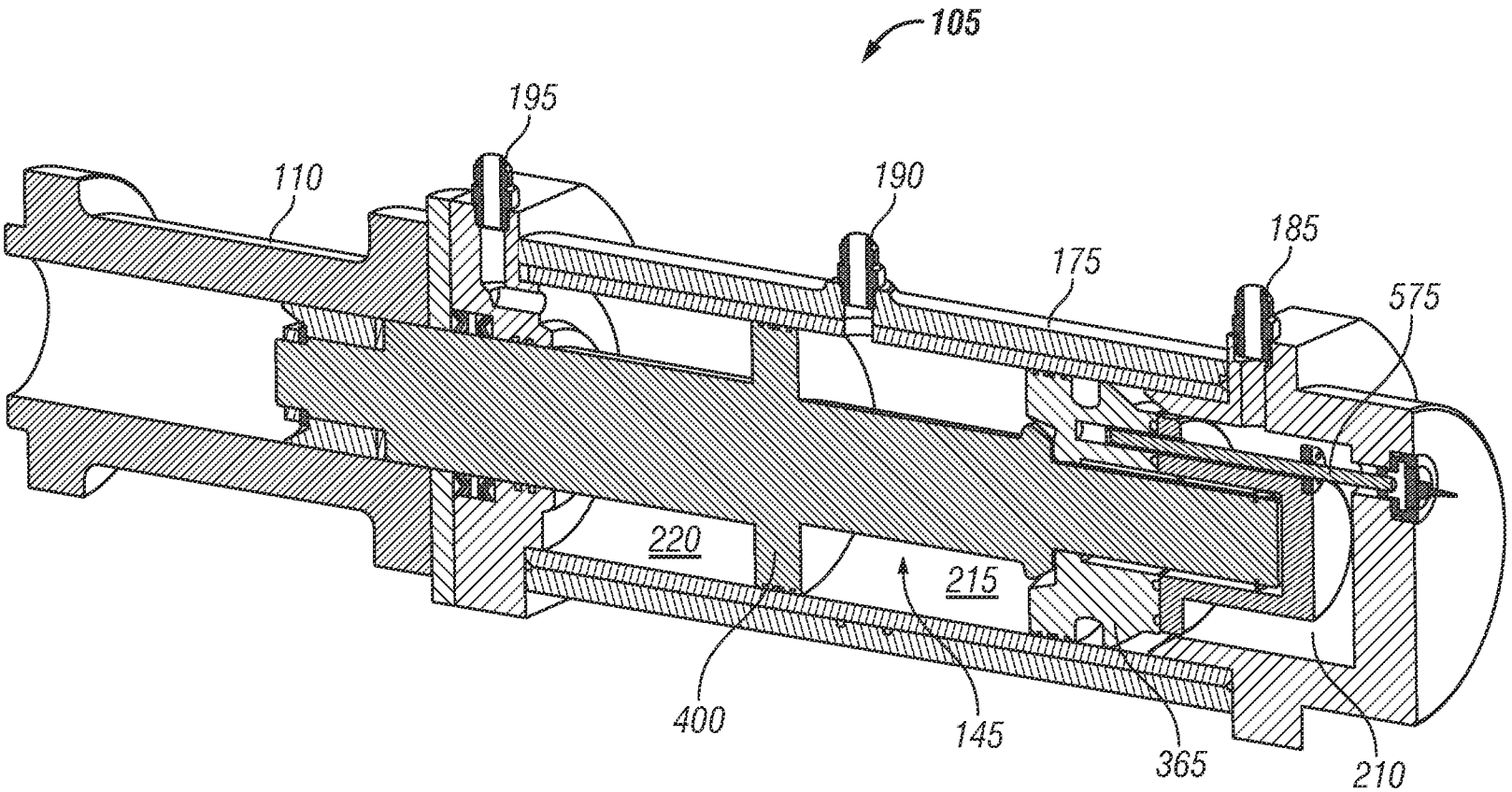
FIG. 10 is a cross-sectional view of the piston-cylinder assembly of FIG. 3 fully stroked back.
Figure 11:
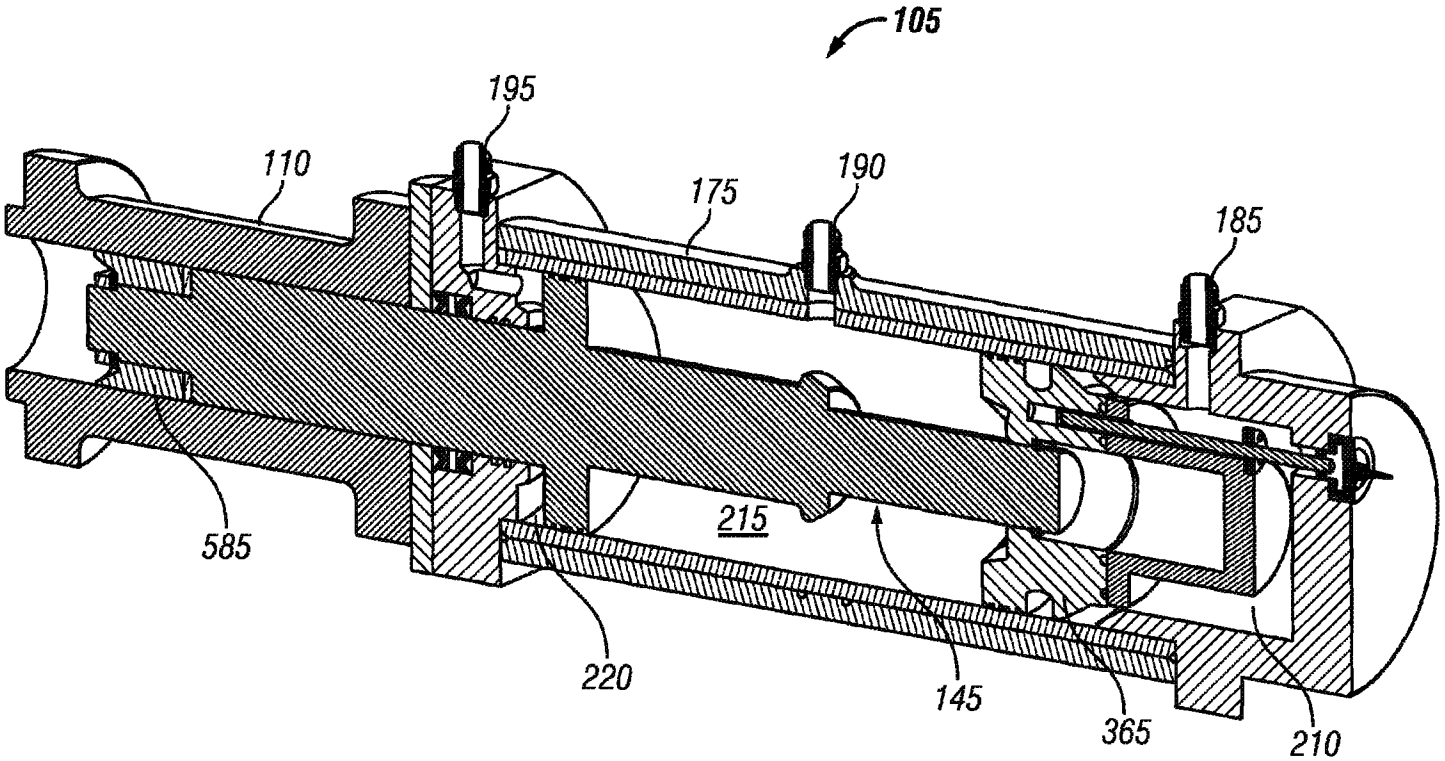
FIG. 11 is a cross-sectional view of the piston-cylinder assembly of FIG. 3 fully stroked out.

During operation of pump 100, piston assembly 145 reciprocates between a fully stroked back position, illustrated by FIG. 10, and a fully stroked out position, illustrated by FIG. 11. Referring initially to FIG. 10, piston assembly 145 is fully stroked back. Control system 345 (FIG. 2) determines piston assembly 145 is fully stroked back based on the axial position of uniform piston 400 relative to stepped piston 365, the axial position of uniform piston 400 relative to cylinder 110, and the fluid pressures sensed by sensors 240, 245, 250. The axial position of uniform piston 400 stepped piston 365 and the axial position of uniform piston 400 relative to cylinder 110 are determined by control system 345 using signals transmitted from linear displacement sensor 575 and coil 660 (FIG. 9) of composite housing 175. When piston assembly 145 is fully stroked back, the pressure of drilling mud within compression chamber 160 and sensed by sensor 240 is approximately equal to the pressure of drilling mud at drilling mud source 130. The pressure of hydraulic fluid within subchamber 220 and sensed by sensor 250 is approximately equal to the pressure of hydraulic fluid in supply network 260. The pressure of hydraulic fluid within subchamber 215 and sensed by sensor 245 is approximately equal to the pressure of hydraulic fluid in return network 265.

Having determined piston assembly 145 is fully stroked back, control system 345 then actuates valve 230 (FIG. 2) to allow hydraulic fluid to pass from supply piping network 260 through valve 230 and port 190 into subchamber 215, actuates valve 235 to allow hydraulic fluid to be relieved from subchamber 220 through port 195 and valve 235 (FIG. 2) into return piping network 265, and actuates valve 225 such that no hydraulic fluid is allowed to enter or leave subchamber 210. As the volume of hydraulic fluid in subchamber 215 increases, the pressure of hydraulic fluid in subchamber 215 acts against piston assembly 145, causing piston assembly 145 to stroke out. As piston assembly 145 strokes out, hydraulic fluid is forced from subchamber 220 through valve 235 into return piping network 265. Also, drilling mud within compression chamber 160 is pressurized and forced therefrom through discharge valve 155 into discharge manifold 125.

When piston assembly 145 is fully stroked out, as illustrated by FIG. 11, control system 345 determines that is the case based on the axial position of uniform piston 400 relative to stepped piston 365, the axial position of uniform piston 400 relative to cylinder 110, and the fluid pressures sensed by sensors 240, 245, 250. The axial position of uniform piston 400 relative to stepped piston 365 and the axial position of uniform piston 400 relative to cylinder 110 are again determined by control system 345 using signals transmitted from linear displacement transducer 575 and coil 660. When piston assembly 145 is fully stroked out, the pressure of drilling mud within compression chamber 160 and sensed by sensor 240 is equal to the discharge pressure of pump 100. The pressure of hydraulic fluid within subchamber 220 and sensed by sensor 250 is approximately equal to the pressure of hydraulic fluid in return network 260. The pressure of hydraulic fluid within subchamber 215 and sensed by sensor 245 is approximately equal to the pressure of hydraulic fluid in supply network 265.

Having determined piston assembly 145 is fully stroked out, control system 345 then actuates valve 235 to allow hydraulic fluid to pass from supply piping network 260 through port 195 and valve 235 into subchamber 220, actuates valve 230 to allow hydraulic fluid to be relieved from subchamber 215 through port 190 and valve 230 into return piping network 265, and actuates valve 225 such that no hydraulic fluid is allowed to enter or leave subchamber 210. As the volume of hydraulic fluid in subchamber 220 increases, the pressure of hydraulic fluid in subchamber 220 acts against piston assembly 145, causing piston assembly 145 to stroke back. As piston assembly 145 strokes back, hydraulic fluid is forced from subchamber 215 through valve 230 into return piping network 265. Also, drilling mud is drawn from suction manifold 120 through suction valve 150 into compression chamber 160.

Once piston assembly 145 returns to its fully stroked back position, illustrated by FIG. 10, the above-described process repeats. Thus, piston assembly 145 is driven to reciprocate within piston-cylinder assembly 105 under fluid pressure provided by hydraulic system 115 in a manner governed by control system 345.

As piston assembly 145 reciprocates, control system 345 actuates valve 225 (FIG. 2) to enable adjustment of the volume of hydraulic fluid within subchamber 210 so as to maintain the discharge pressure of drilling mud exhausted from piston-cylinder assembly 105 substantially at a pre-selected pressure setting, or within a pre-selected pressure range. If the pressure sensed by sensor 240 (FIG. 2) and communicated to control system 345 is lower than the pre-selected pressure, or pressure range, control system 345 actuates valve 225 to enable the addition hydraulic fluid from supply network 260 to subchamber 210. This causes piston cover 370/stepped piston 365 and, in turn, piston assembly 145 to stroke out, thereby increasing the pressure of drilling mud within compression chamber 160 and thus the discharge pressure of drilling mud exhausted therefrom. On the other hand, if the pressure sensed by sensor 240 is higher than the pre-selected pressure, or pressure range, control system actuates valve 225 to enable relief of hydraulic fluid from subchamber 210 into return network 265. This enables piston cover 370/stepped piston 365 and, in turn, piston assembly 145 to stroke back, thereby decreasing the pressure of drilling mud in compression chamber 160 and the discharge pressure of drilling mud exhausted therefrom.

Adjustment of the volume of hydraulic fluid within subchamber 210 enables dampening of pressure fluctuations in compression chamber 160, including those created by contact between piston assembly 145 and piston seal 585 disposed thereabout with the drilling mud, leakage of suction valve 150, and/or leakage of discharge valve 155. As previously explained, pressure fluctuations are undesirable because they may disturb, even damage, instrumentation downstream of pump 100. Thus, hydraulically driven pump 100 dampens pressure fluctuations that are otherwise present in conventional reciprocating pumps.

In the embodiment described above and illustrated by FIGS. 1 through 10, hydraulically driven pump 100 includes three piston-cylinder assemblies 105, each assembly 105 having a uniform piston 400 and a stepped piston 365 that sealingly engage inner surface 205 of composite housing 175 and translate relative to composite housing 175. The translational movements of pistons 365, 400 may cause sealing elements 515, 420 (FIGS. 6, 4) to be subject to wear. In other embodiments of a hydraulically driven pump in accordance with the principles disclosed herein, the piston assemblies may be configured differently so as to reduce the effects of wear. FIGS. 12 through 17 illustrate one such embodiment.

Figure 12:
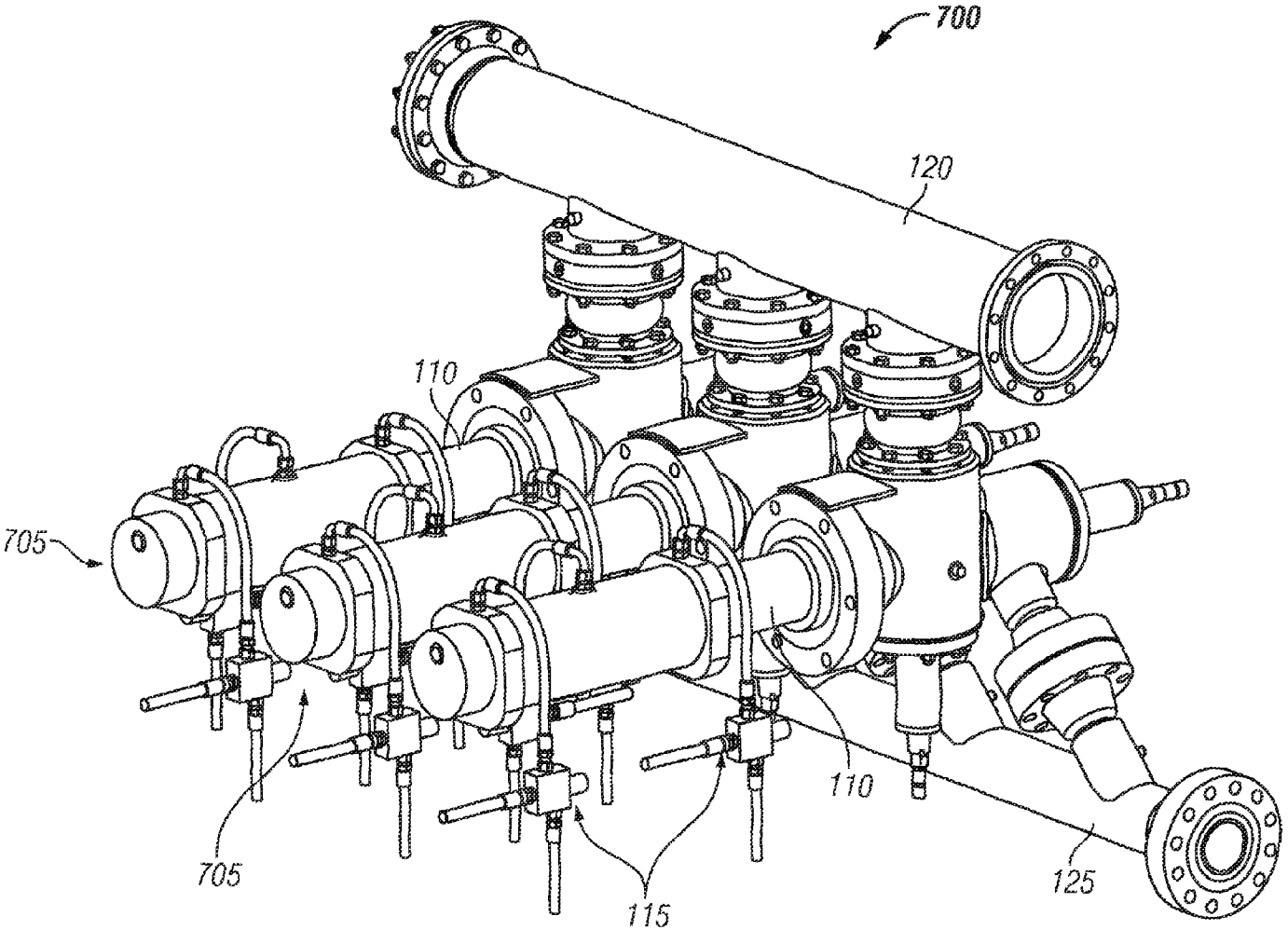
FIG. 12 is a perspective view of another hydraulically driven reciprocating pump in accordance with the principles disclosed herein.

Referring to FIG. 12, there is shown a hydraulically driven reciprocating pump 700 for pressurizing a working fluid, such as but not limited to drilling mud. Reciprocating pump 700 includes three substantially identical piston-cylinder assemblies 705. From the exterior, pump 700 appears substantially identical, if not identical, to pump 100, previously described. Indeed, many of the components of pump 700 are identical to those of pump 100, both in design and function. As such, these components retain the same reference characters and will not be described again for the sake of brevity.

Each piston-cylinder assembly 705 includes a piston assembly (not visible in FIG. 12, but identified in FIG. 13 by reference number 710) translatably disposed for reciprocating movement within a cylinder 110, previously described. The piston assemblies are driven out of phase with each other, meaning the position of each relative to its associated cylinder 110 is different than that of the other piston assemblies at any given instant. In certain embodiments, piston-cylinder assemblies 705 are operated 120 degrees out of phase with each other. Even so, other phase relationships may also be employed. The piston assemblies are driven by hydraulic system 115 that is, in turn, governed by control system 345, both systems 115, 345 previously described.

Figure 13:
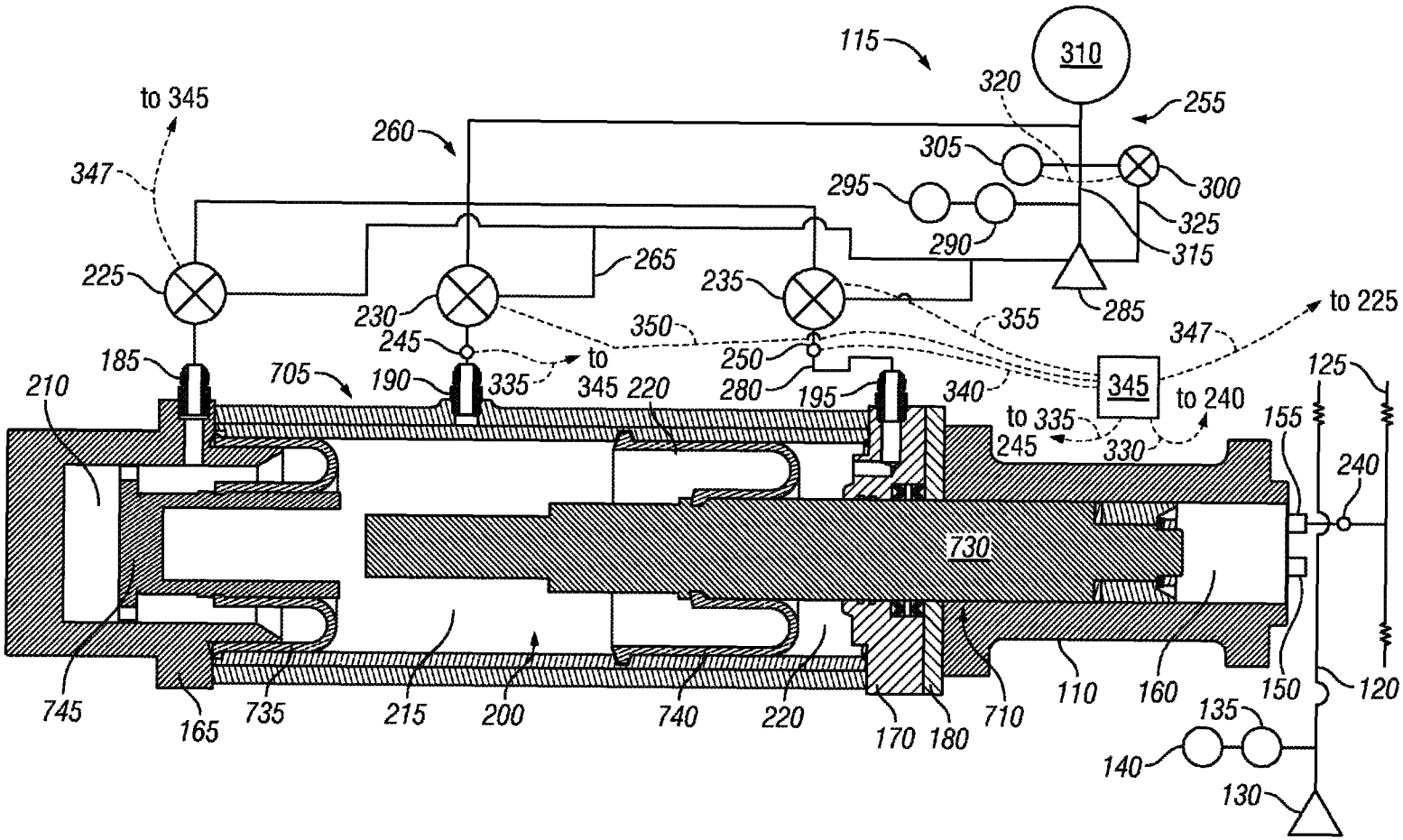
FIG. 13 is a cross-sectional, lengthwise view of one piston-cylinder assembly of FIG. 12 fluidicly coupled with the hydraulic system and electrically coupled the control system, the hydraulic system and the control system both schematically represented.

Each piston-cylinder assembly 705 is coupled between suction manifold 120 and discharge manifold 125. Referring to FIG. 13, which, for simplicity, illustrates only one piston-cylinder assembly 705, drilling mud is delivered from source 130 via pump 135 driven by motor 140 through suction manifold 120 to cylinder 110. As piston assembly 710 is stroked back within cylinder 110, drilling mud is drawn through suction valve 150 into compression chamber 160 within cylinder 110. After piston assembly 710 reverses direction, drilling mud contained within compression chamber 160 is pressurized by piston assembly 710. As piston assembly 710 approaches the end of its stroke, the pressurized drilling mud is exhausted from cylinder 110 through discharge valve 155 into discharge manifold 125. Thus, as piston assembly 710 reciprocates within cylinder 110, piston-cylinder 705 repeatedly receives drilling mud from suction manifold 120, pressurizes the drilling mud received, and delivers the pressurized drilling mud to discharge manifold 125.

Figure 14:
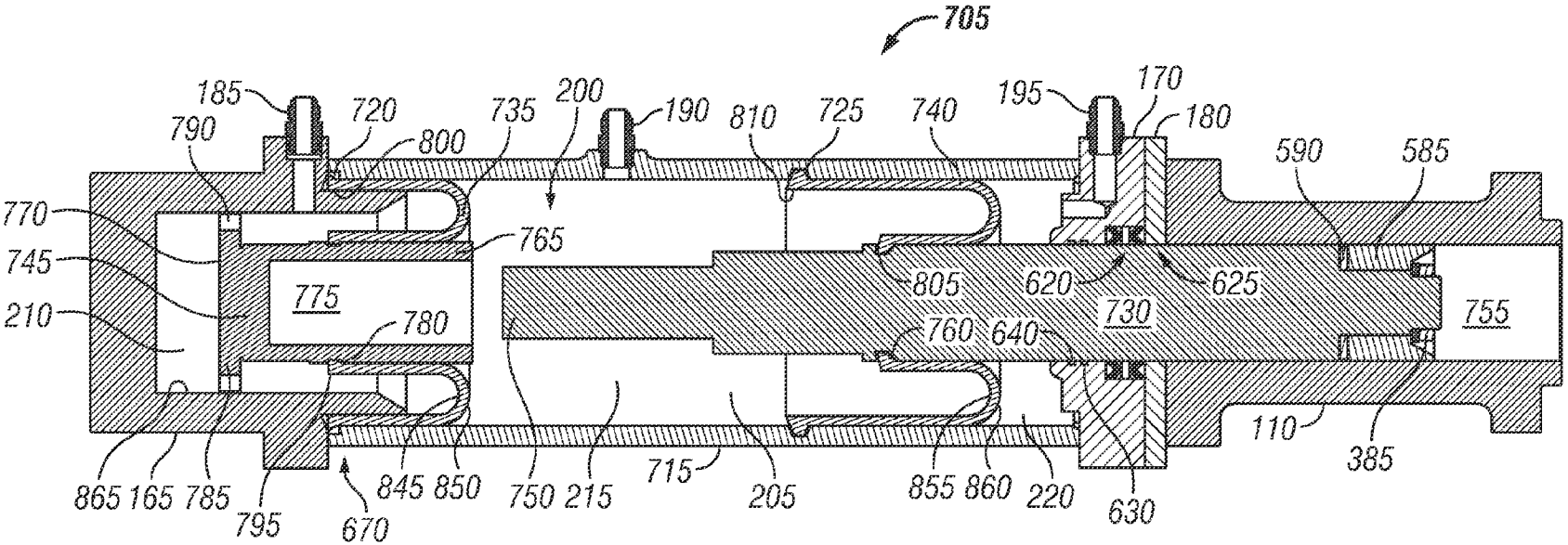
FIG. 14 is a cross-sectional, lengthwise view of the piston-cylinder assembly of FIG. 13.

Referring now to FIG. 14, piston-cylinder assembly 705 further includes two flanges 165, 170, a composite housing 715 disposed therebetween, and circular plate 180. Cylinder 110 is coupled to flange 170 with plate 180 disposed therebetween. Flanges 165, 170 and composite housing 715 form hydraulic chamber 200. Also, each of flange 165, composite housing 715, and flange 170 have hydraulic fluid port 185, 190, 195, respectively, fluidicly coupled with hydraulic chamber 200.

Composite housing 715 is substantially identical to composite housing 175 of pump 100, previously described, both in design and function, but for two differences. First, composite housing 715 has an annular groove or recess 720 formed in inner surface 205 proximate end 670. Second, composite housing 715 has another similar annular groove or recess 725 formed in inner surface 205 approximately midway between ports 190, 195. Recesses 720, 725 enable coupling of two bladder pistons 735, 740 to composite housing 715, as will be described.

Piston-cylinder 705 further includes bladder pistons 735, 740, mentioned above, and a piston cover 745. Piston cover 745 is translatable to reciprocate within flange 165 and composite housing 715 relative to piston assembly 710. Bladder piston 740 is coupled between piston assembly 710 and composite housing 715. Bladder piston 735 is coupled between piston cover 745 and composite housing 715. Bladder pistons 735, 740 divide hydraulic chamber 200 into subchambers 210, 215, 220. Subchamber 210 is disposed between bladder piston 735 and flange 165. Subchamber 220 is disposed adjacent flange 170, and subchamber 215 is disposed between subchambers 210, 220. Hydraulic fluid ports 185, 190, 195 are fluidicly coupled with subchambers 210, 215, 220, respectively.

Piston assembly 710 includes an axially extending body 730. Body 730 is generally cylindrical member with two opposing ends 750, 755. Body 730 extends through aligned bores 620, 625 in flange 170 and circular plate 180, respectively, between compression chamber 160 of cylinder 110 and hydraulic chamber 200 within composite housing 715. Further, body 730 is axially translatable relative to piston cover 745 to reciprocate within composite housing 715 and cylinder 110. Sealing elements 640, disposed within grooves 630 of flange 170, enable sealing engagement between flange 170 and body 730, limiting or preventing the loss of hydraulic fluid from subchamber 220 at this interface. Body 730 includes an annular groove or recess 760 formed its outer surface approximately midway between ends 750, 755. Annular recess 760 is configured to receive a flanged end of bladder piston 740 to enable coupling of bladder piston 740 with body 730, described further below.

Ends 750, 755 of body 730 are reduced diameter portions, meaning each has a diameter that is smaller than that of the remainder of body 730 extending therebetween. Reduced diameter end 755 is translatably received within cylinder 110 and receives backup seal 590, piston seal 585, and coupling 385, previously described. Depending upon the axial position of piston cover 745 relative to body 730, reduced diameter end 750 may be translatably received within piston cover 745.

Piston cover 745 is axially translatable relative to body 730 to reciprocate within flange 165 and composite housing 715. Piston cover 745 is an annular member having two opposing ends 765, 770, a bore 775, and an annular groove or recess 780 formed in the outer surface of piston cover 745 approximately midway between ends 765, 770. Bore 775 extends from end 765 of piston cover 745 and is configured to receive end 750 of body 730. Annular recess 780 is configured to receive a flanged end of bladder piston 735, described further below, to enable coupling of bladder piston 735 with piston cover 745.

At end 770, piston cover 745 has a radially extending flange 785. Flange 785 slidably engages the inner surface 865 of flange 165 and enables alignment of the axial centerline of bore 775 with the axial centerline of body 730. Flange 785 includes a plurality of circumferentially spaced throughbores 790 extending therethrough. Throughbores 790 enable hydraulic fluid to pass freely therethrough. This prevents hydraulic fluid from being trapped between piston cover 745 and flange 165, whereby the trapped fluid reacts against piston cover 745 to resist or prevent piston cover 745 from translating axially toward flange 165.

Bladder piston 735 is a flexible member with two flanged ends 795, 800. Flanged end 795 is seated in annular recess 780 of piston cover 745. Flanged end 800 is seated in annular recess 720 of composite housing 715 and compressed between composite housing 715 and flange 165 to secure end 800 in position. Bladder piston 740 is also a flexible member with two flanged ends 805, 810. Flanged end 805 is seated in annular recess 760 of body 730, and flanged end 810 is seated in annular recess 725 of composite housing 715.

Figure 15:
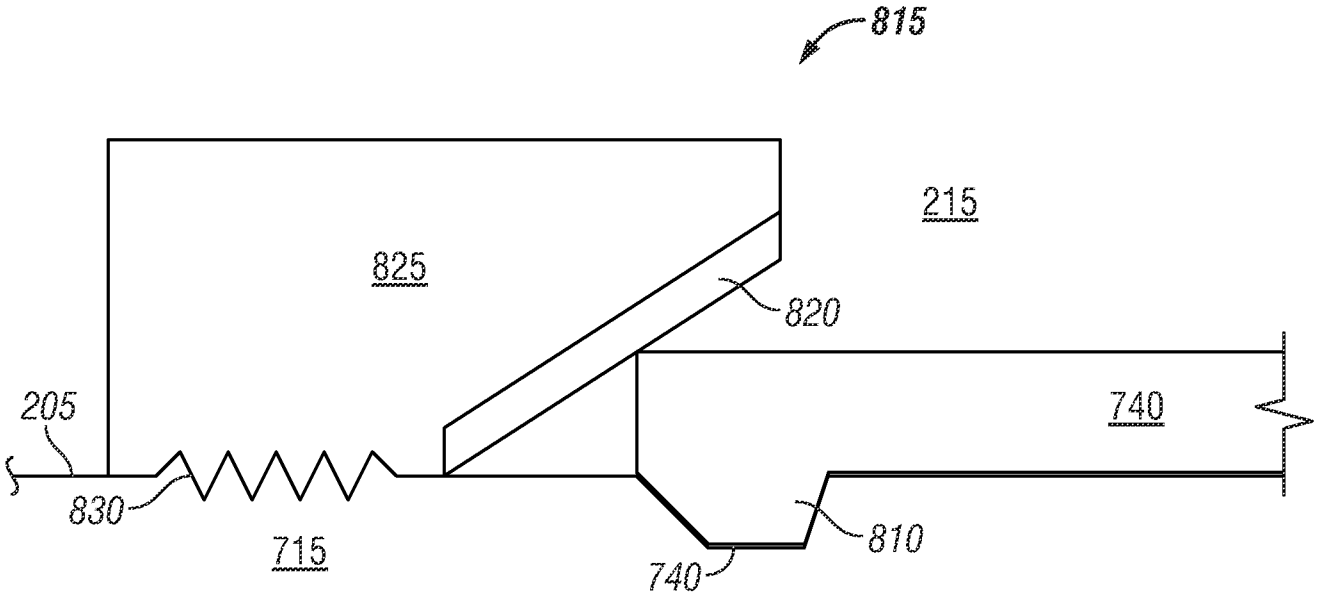
FIG. 15 is a schematic, cross-sectional representation of the coupling of one bladder piston to the composite housing of FIG. 14.

Each of end 795 of bladder piston 735, end 810 of bladder piston 740, and end 805 of bladder piston 740 is secured to piston cover 745, composite housing 715, and body 730, respectively, via a coupling (not shown in FIG. 14, but identified in FIG. 15 by reference number 815). In some embodiments, illustrated by FIG. 15, each coupling 815 includes a ring 820 and a threaded nut 825. FIG. 15 depicts flanged end 810 of bladder piston 740 secured to composite housing 715 by coupling 815. End 810 of bladder piston 740 is seated in annular recess 725 of composite housing 715. Ring 820 of coupling 815 is seated inside of and against flanged end 810 of bladder piston 740. Nut 825 is threaded into a plurality of threads 830 formed in inner surface 205 of composite housing 715 adjacent annular recess 740 to compress ring 820 against flanged end 810. The compression load applied by nut 825 through ring 820 to end 810 secures end 810 of bladder piston 740 to composite housing 715. At the same time, ring 820 prevents end 810 from being damaged due to the applied compression load and bladder piston 740 from stretching as nut 825 is threaded into threads 830 of composite housing 715.

End 795 of bladder piston 735 and end 805 of bladder piston 740 are similarly secured to piston cover 745 and body 730, respectively, via couplings 815. However, in those instances, the couplings 815 are disposed about, rather than within, piston cover 745 and body 730 and threaded thereto with end 795 of bladder piston 735 and end 805 of bladder piston 740, respectively, secured therebetween.

Referring again to FIG. 14, bladder piston 735 has an interior surface 845 adjacent subchamber 210 and an exterior surface 850 adjacent subchamber 215. As previously described, piston cover 745 is axially translatable within composite housing 715. When hydraulic fluid is injected into subchamber 210, the pressure load of hydraulic fluid within subchamber 210 acting over interior surface 845 of bladder piston 735 increases. If the pressure load over interior surface 845 exceeds the pressure load of hydraulic fluid within subchamber 215 acting on exterior surface 850, bladder piston 735 flexes and end 795 of bladder piston 735 displaces toward flange 170, causing piston cover 745 to stroke out, or move to the right as viewed in FIG. 14. Conversely, when hydraulic fluid is injected into subchamber 215, the pressure load of hydraulic fluid within subchamber 215 acting over exterior surface 850 of bladder piston 735 increases. If the pressure load over exterior surface 850 exceeds the pressure load of hydraulic fluid within subchamber 210 acting on interior surface 845, bladder piston 735 again flexes and end 795 of bladder piston 735 displaces in the opposite direction, or toward flange 165, causing piston cover 745 to stroke back, or move to the left as viewed in FIG. 14. Thus, depending upon the pressure difference between subchambers 210, 215, bladder piston 735 flexes and "rolls" in one direction or the other, causing piston cover 745 to stroke out or back.

Likewise, bladder piston 740 has an interior surface 855 adjacent subchamber 215 and an exterior surface 860 adjacent subchamber 220. As previously described, body 730 is axially translatable within composite housing 715. When hydraulic fluid is injected into subchamber 215, the pressure load of hydraulic fluid within subchamber 215 acting over interior surface 855 of bladder piston 740 increases. If the pressure load over interior surface 855 exceeds the pressure load of hydraulic fluid within subchamber 220 acting on exterior surface 860, bladder piston 740 flexes and end 805 of bladder piston 740 displaces toward flange 170, causing body 730 to stroke out, or move to the right as viewed in FIG. 14. Conversely, when hydraulic fluid is injected into subchamber 220, the pressure load of hydraulic fluid within subchamber 220 acting over exterior surface 860 of bladder piston 740 increases. If the pressure load over exterior surface 860 exceeds the pressure load of hydraulic fluid within subchamber 215 acting on interior surface 855, bladder piston 740 again flexes and end 805 of bladder piston 740 displaces in the opposite direction, or toward flange 165, causing body 730 to stroke back, or move to the left as viewed in FIG. 14. Thus, depending upon the pressure difference between subchambers 215, 220, bladder piston 740 flexes and "rolls" in one direction or the other, causing body 730 to stroke out or back.

Figure 16A:
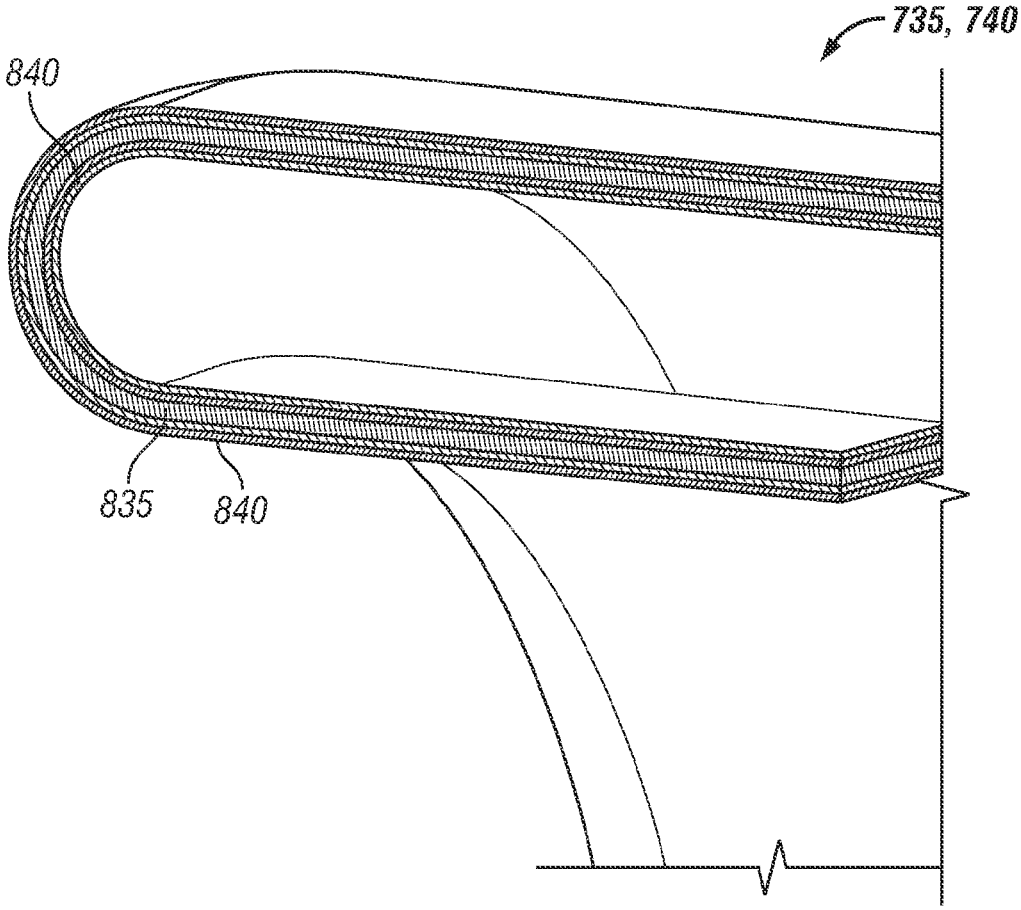
FIG. 16A is a cross-sectional view of one bladder piston of FIG. 14.
Figure 16B:
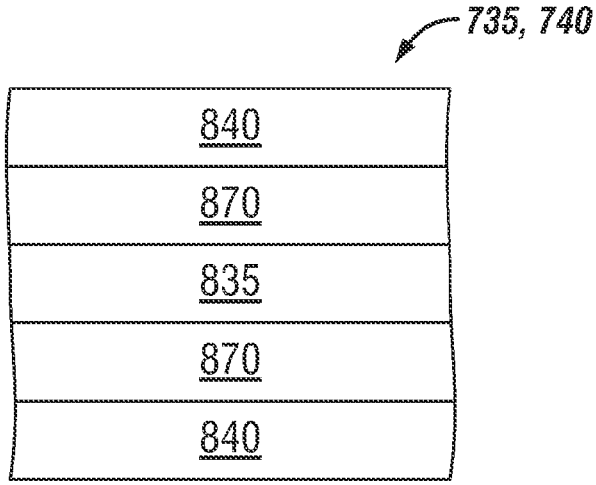
FIG. 16B is a schematic representation of the various layers forming the bladder piston of FIG. 16A.

In the embodiments illustrated by FIGS. 15A and 15B, each of bladder pistons 735, 740 is a composite flexible member. FIG. 16A depicts a partial cross-sectional view of each bladder 735, 740. FIG. 16B is a schematic representation of a cross-section of each bladder 735, 740, illustrating the various material layers forming the bladder. As shown, each bladder piston 735, 740 has an inner layer 835 disposed between two outer layers 840 with a fabric layer 870 disposed between each of outer layers 840 and inner layer 835. The inner layer 835 comprises a material that is more compliant or flexible than the material of outer layers 840. For example, inner layer 835 may comprise a soft rubber, and outer layers 840 may comprise hard rubber. Each fabric layer 870 comprises a natural fiber, such as but not limited to cotton or preferably an aramide fiber. Inner layer 835, comprising a more compliant or flexible material than that of outer layers 840, accommodates the relative displacement of outer layers 840 due to movement of piston cover 745 or body 730 and protects fabric layers 870 from damage that may otherwise occur in the absence of inner layer 835 due to continual flexing of the bladder. In a sense, inner layer 835 acts as a lubricant disposed between outer layers 840. In some embodiments, bladder pistons 735, 740 are bladder diaphragms manufactured by Bellofram Corporation, headquartered at 8019 Ohio River Blvd., Newell, W. Va. 26050. Also, fabric layers 870 may comprise fabric manufactured by Hexcel Corporation, headquartered at 281 Tresser Blvd., Stamford, Conn. 06901.

Figure 17:
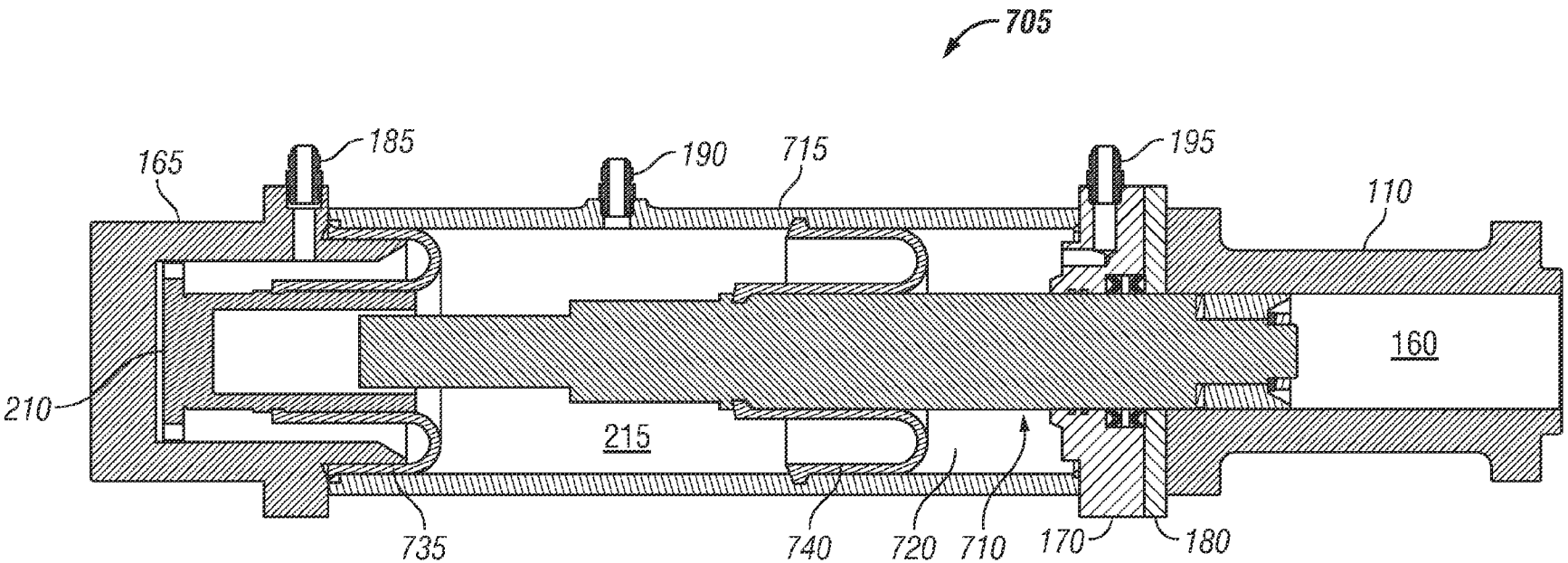
FIG. 17 is a cross-sectional view of the piston-cylinder assembly of FIG. 14 fully stroked back.
Figure 18:
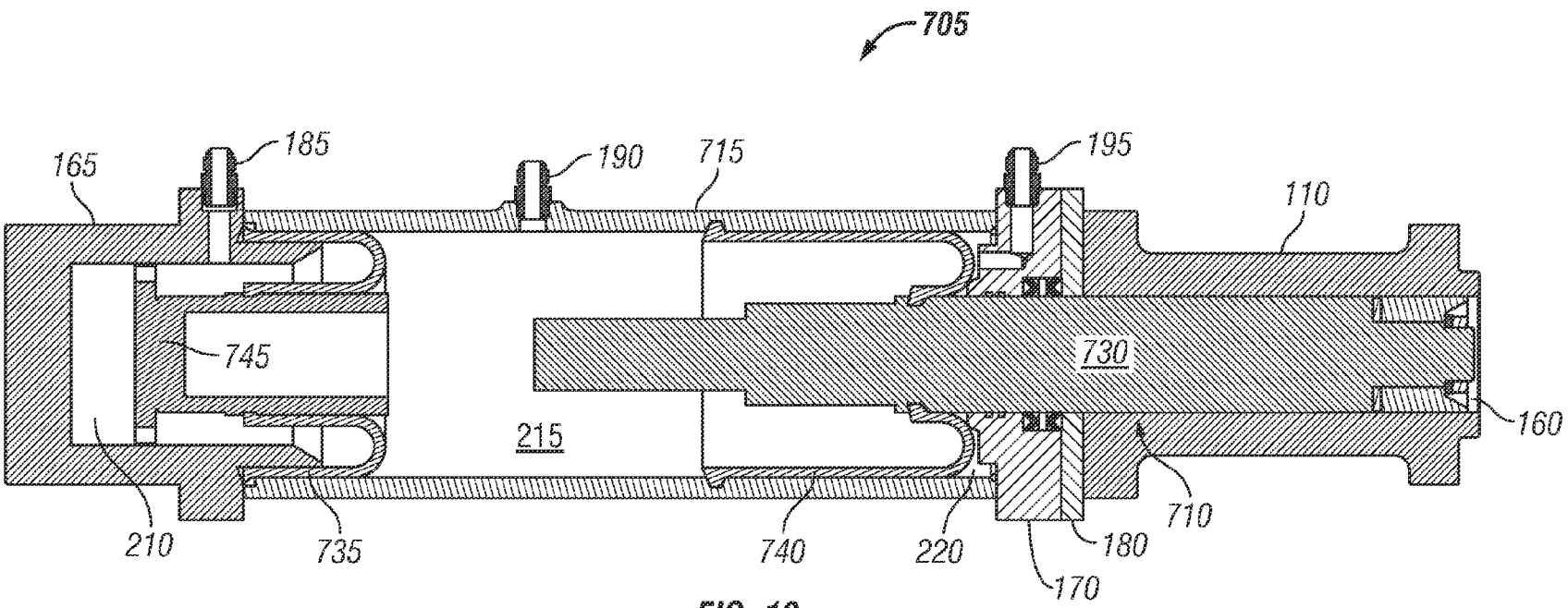
FIG. 18 is a cross-sectional view of the piston-cylinder assembly of FIG. 14 fully stroked out.

During operation of pump 700, piston assembly 710 reciprocates between a fully stroked back position, illustrated by FIG. 17, and a fully stroked out position, illustrated by FIG. 18. Referring initially to FIG. 17, piston assembly 710 is fully stroked back. Control system 345 determines piston assembly 710 is fully stroked back based on the axial position of bladder piston 740 relative to that of bladder piston 735, the axial position of bladder piston 740 relative to that of cylinder 110, and the fluid pressures sensed by sensors 240, 245, 250. The axial position of bladder piston 740 relative to that of bladder piston 735 and the axial position of bladder piston 740 relative to that of cylinder 110 are determined by control system 345 using signals transmitted from coil 660 of composite housing 715. When piston assembly 710 is fully stroked back, the pressure of drilling mud within compression chamber 160 and sensed by sensor 240 is approximately equal to the pressure of drilling mud at drilling mud source 130. The pressure of hydraulic fluid within subchamber 220 and sensed by sensor 250 is approximately equal to the pressure of hydraulic fluid in supply network 260. The pressure of hydraulic fluid within subchamber 215 and sensed by sensor 245 is approximately equal to the pressure of hydraulic fluid in return network 265.

Having determined piston assembly 710 is fully stroked back, control system 345 then actuates valve 230 to allow hydraulic fluid to pass from supply piping network 260 through valve 230 into subchamber 215, actuates valve 235 to allow hydraulic fluid to be relieved from subchamber 220 through valve 235 into return piping network 265, and actuates valve 225 such that no hydraulic fluid is allowed to enter or leave subchamber 210. As the volume of hydraulic fluid in subchamber 215 increases, the pressure of hydraulic fluid in subchamber 215 acts against bladder piston 740, causing bladder piston 740 to flex and "roll" and piston assembly 710 to stroke out. The rolling motion of bladder piston 740 in a direction toward flange 170 forces hydraulic fluid from subchamber 220 through valve 235 into return piping network 265. Also, as piston assembly 710 strokes out, drilling mud within compression chamber 160 is pressurized and forced therefrom through discharge valve 155 into discharge manifold 125.

When piston assembly 710 is fully stroked out, as illustrated by FIG. 18, control system 345 determines that is the case based on the axial position of bladder piston 740 relative to that of bladder piston 735, the axial position of bladder piston 740 relative to that of cylinder 110, and the fluid pressures sensed by sensors 240, 245, 250. The axial position of bladder piston 740 relative to that of bladder piston 735 and the axial position of bladder piston 740 relative to that of cylinder 110 are again determined by control system 345 using signals transmitted from coil 660. When piston assembly 710 is fully stroked out, the pressure of drilling mud within compression chamber and sensed by sensor 240 is equal to the discharge pressure of pump 100. The pressure of hydraulic fluid within subchamber 220 and sensed by sensor 250 is approximately equal to the pressure of hydraulic fluid in return network 260. The pressure of hydraulic fluid within subchamber 215 and sensed by sensor 245 is approximately equal to the pressure of hydraulic fluid in supply network 265.

Having determined piston assembly 710 is fully stroked out, control system 345 then actuates valve 235 to allow hydraulic fluid to pass from supply piping network 260 through valve 235 into subchamber 220, actuates valve 230 to allow hydraulic fluid to be relieved from subchamber 215 through valve 230 into return piping network 265, and actuates valve 225 such that no hydraulic fluid is allowed to enter or leave subchamber 210. As the volume of hydraulic fluid in subchamber 220 increases, the pressure of hydraulic fluid in subchamber 220 acts against bladder piston 740, causing bladder piston 740 to flex and roll in the opposite direction and piston assembly 710 to stroke back. The rolling movement of bladder piston 740 in a direction toward flange 165 forces hydraulic fluid from subchamber 215 through valve 230 into return piping network 265. Also, as piston assembly 710 strokes back, drilling mud is drawn from suction manifold 120 through suction valve 150 into compression chamber 160.

Once piston assembly 710 returns to its fully stroked back position, illustrated by FIG. 17, the above-described process repeats. Thus, piston assembly 710 is driven to reciprocate within piston-cylinder assembly 705 under fluid pressure provided by hydraulic system 115 in a manner limited by control system 345.

As piston assembly 710 reciprocates, control system 345 actuates valve 225 to enable adjustment of the volume of hydraulic fluid within subchamber 210 so as to maintain the discharge pressure of drilling mud exhausted from piston-cylinder assembly 705 substantially at the pre-selected pressure setting, or within a pre-selected pressure range, and prevents the loss of hydraulic fluid from subchamber 210 in response to pressurization of subchamber 215, which would otherwise allow bladder piston 735, rather than bladder piston 740, to flex and "roll." If the pressure sensed by sensor 240 and communicated to control system 345 is lower than pre-selected pressure, or pressure range, control system 345 actuates valve 225 to enable the addition of hydraulic fluid from supply network 260 to subchamber 210. This causes bladder piston 735 to flex and roll in a direction toward flange 170 and piston cover 745 to stroke out. In turn, piston assembly 710 strokes out, thereby increasing the pressure of drilling mud within compression chamber 160 and thus the discharge pressure of drilling mud exhausted therefrom. On the other hand, if the pressure sensed by sensor 240 and communicated to control system 345 is higher than pre-selected pressure, or pressure range, control system 345 actuates valve 225 to enable relief of hydraulic fluid from subchamber 210 into return network 265. This enables bladder piston 735 to flex and roll in the opposite direction, or toward flange 165, and piston cover 745 to stroke back. In turn, piston assembly 710 strokes back, thereby decreasing the pressure of drilling mud in compression chamber 160 and the discharge pressure of drilling mud exhausted therefrom.

Adjustment of the volume of hydraulic fluid within subchamber 210 by valve 225 enables dampening of pressure fluctuations created in the drilling mud within compression chamber 160, including those created by contact between piston assembly 710 and piston seal 585 disposed thereabout with the drilling mud, leakage of suction valve 150, and/or leakage of discharge valve 155. Thus, hydraulically driven pump 700 dampens pressure fluctuations that are otherwise present in conventional reciprocating pumps.

Moreover, because ends 795, 800 of bladder piston 735 remain fixed relative to piston cover 745 and composite housing 715, respectively, and do not translate relative to or against these components 745, 715, ends 795, 800 are not subject to wear, as are sealing elements 515 of stepped piston 365 of pump 100. Ends 805, 810 of bladder piston 740 are also not subject to wear, as are sealing elements 420 of uniform piston 400 of pump 100, for the same reason. Thus, pump 700 is believed to be less susceptible to wear than pump 100 and in theory will require less servicing.

In the above-described embodiments of pump 100, 700, subchamber 215 is pressurized via hydraulic fluid to cause piston assembly 145, 710 to stroke out, and subchamber 220 is subsequently pressurized by hydraulic fluid to cause piston assembly 145, 710 to stroke back. At the same time, the volume of hydraulic fluid in subchamber 210 is continuously adjusted to maintain a substantially constant discharge pressure of drilling mud exhausted from cylinder 110. Thus, subchamber 210 may be described as a pressure compensating subchamber while subchambers 215, 220 may be described as forward stroking and backward stroking subchambers, respectively.

In other embodiments of pump 100 and/or pump 700, the function of subchambers 210, 215 may be interchanged. In other words, pump 100 and/or pump 700 may be modified such that subchamber 215 is the pressure compensating subchamber, and subchamber 210 is the forward stroking subchamber while subchamber 220 remains the backward stroking subchamber. In such embodiments, control system 345 governs the opening and closing of valves 225, 235 dependent upon pressures sensed by sensors 240, 245, 250 to supply hydraulic fluid in an alternating fashion to subchamber 210 while relieving hydraulic fluid from subchamber 220 and to subchamber 220 while relieving hydraulic fluid from subchamber 210. When subchamber 210 is supplied with hydraulic fluid, or pressurized, subchamber 220 is relieved of hydraulic fluid, or de-pressurized, and vice versa. Cyclic pressurization of subchambers 210, 220 and substantially simultaneous depressurization of chambers 220, 210 enables piston assembly 145, 710 to be driven by fluid pressure. When subchamber 210 is pressurized, piston assembly 145, 710 strokes out, pushing hydraulic fluid from subchamber 220 through port 195, referring to FIGS. 2 and 12 for exemplary purposes. When subchamber 220 is subsequently pressurized, piston assembly 145, 710 strokes back, pushing hydraulic fluid from subchamber 210 through port 185. At the same time, control system 345 governs the opening and closing of valve 230 to adjust the volume of hydraulic fluid in subchamber 215 to maintain the discharge pressure of pump 100 substantially constant, or within a pre-selected range.

In still other embodiments, subchamber 215 may be both forward stroking and pressure compensating. Referring to FIGS. 2 and 12 for exemplary purposes, in such embodiments, control system 345 governs valve 225 such that the volume of hydraulic fluid within subchamber 210 remains constant. Also, control system 345 actuates valve 230, not valve 225, to enable adjustment of the volume of hydraulic fluid within subchamber 215, not subchamber 210, so as to maintain the discharge pressure of drilling mud exhausted from piston-cylinder assembly 105, 705 substantially at the pre-selected pressure setting, or within the pre-selected pressure range. Otherwise, operation of pump 100, 700 remains substantially the same as described above.

Further, adjustment of the pre-selected pressure settings of valves 225, 230, 235 of pump 100 and/or pump 700 enables a significant change in the discharge pressure of the pumps without the need to change out various components of the pumps, or the use of a different pump. In contrast, a conventional reciprocating pump used to pump drilling fluid typically provides pressurized fluid within a specified, and narrower, range dependent upon the size and stroke of its piston. When discharge pressures outside of that range are desired, at least the piston and cylinder of the conventional pump must be replaced, or another pump used altogether. Pumps 100, 700 are not limited to such applications wherein drilling mud is pressurized to within a narrow range. Rather, a single pump 100, 700 may accommodate a wide range of discharge pressure, which would otherwise require two or more conventional pumps and/or modification to at least one of the conventional pumps.

While various embodiments have been shown and described, modifications thereof can be made by one skilled in the art without departing from the spirit and teachings herein. The embodiments herein are exemplary only, and are not limiting. Many variations and modifications of the apparatus disclosed herein are possible and within the scope of the invention. Accordingly, the scope of protection is not limited by the description set out above, but is only limited by the claims which follow, that scope including all equivalents of the subject matter of the claims.

What is claimed is:

1. A pump comprising:

a housing having a hydraulic chamber;

a first piston in the hydraulic chamber;

a second piston separating the hydraulic chamber into at least a first subchamber and a second subchamber, and disposed for reciprocal motion within the housing;

the first piston defining a third subchamber in the hydraulic chamber, wherein the first piston is movable relative to the second piston;

a hydraulic system fluidicly coupled with the first subchamber, the second subchamber, and the third subchamber, the hydraulic system actuatable to:

deliver hydraulic fluid to the second subchamber, whereby the second subchamber is pressurized and the second piston translates in a first direction from a stroked back position toward a stroked out position;

deliver hydraulic fluid to the first subchamber, whereby the first subchamber is pressurized and the second piston translates in a second direction opposite the first direction from the stroked out position toward the stroked back position; and deliver hydraulic fluid to the third subchamber to move the first piston relative to the second piston;

wherein the first piston, the second piston, the first subchamber, the second subchamber, and the third subchamber are aligned along a same central axis.

2. The pump of claim 1, wherein the second piston is in sealing engagement with an inner surface of the housing.

3. The pump of claim 1, further comprising a control system operable to actuate the hydraulic system to pressurize the second subchamber when the second piston is in the stroked back position and to pressurize the first subchamber when the second piston is in the stroked out position, whereby the second piston reciprocates within the housing.

4. The pump of claim 3, further comprising a cylinder coupled to the housing and wherein the second piston is disposed partially within the cylinder and partially within the housing, the second piston drawing a working fluid into the cylinder when translating in the second direction and exhausting the working fluid from the cylinder when translating in the first direction.

5. The pump of claim 4, further comprising means for detecting an axial position of the second piston, a first pressure sensor operable to sense a pressure of hydraulic fluid in the first subchamber, a second pressure sensor operable to sense a pressure of hydraulic fluid in the second subchamber, and a third pressure sensor operable to sense a pressure of the working fluid exhausted from the cylinder; and wherein the control system is operable to determine when the second piston is in either of the stroked out and stroked back positions as a function of the axial position of the second piston and at least one of the first pressure, the second pressure, and the third pressure.

6. The pump of claim 5, wherein said means for detecting is one of a linear displacement transducer coupled to the second piston and a resistive coil embedded in the housing, the coil having a resistance that changes in response to an applied pressure load.

7. The pump of claim 5, wherein the hydraulic system is actuatable to add hydraulic fluid to the third subchamber when the third pressure is below a pre-selected minimum value, whereby the second piston translates in the first direction, and to relieve hydraulic fluid from the third subchamber when the third pressure exceeds a pre-selected maximum value, whereby the second piston translates in the second direction.

8. A pump comprising:

a housing including a hydraulic chamber;

a cylinder coupled to the housing;

a first piston in the hydraulic chamber;

a second piston adapted for reciprocal motion within the housing and the cylinder, the second piston separating the hydraulic chamber into a first subchamber and a second subchamber;

the first piston adapted for reciprocal motion within the housing and relative to the second piston, the first piston forming a third subchamber within the hydraulic chamber;

a hydraulic system fluidicly coupled to each of the subchambers, the hydraulic system including an electronic control system and a valve system coupled to the electronic control system;

wherein the hydraulic system is actuatable to:

deliver hydraulic fluid to the first subchamber, whereby the second piston strokes back to a first position and a working fluid is drawn into the cylinder;

deliver hydraulic fluid to the second subchamber, whereby the second piston strokes out to a second position and the working fluid is exhausted from the cylinder; and control a volume of hydraulic fluid within the third subchamber wherein the control system electrically controls the valve system to at least three valve positions: a first valve position which seals the first subchamber from entry or exit of hydraulic fluid, a second valve position which enables the addition of hydraulic fluid from a supply network, and a third valve position which enables relief of hydraulic fluid to a return network;

wherein the volume of hydraulic fluid within the third subchamber is controlled at any time when the second piston is at or between the first and second positions, whereby the second piston translates to bring a pressure of the working fluid in the cylinder to within a pre-selected range.

9. The pump of claim 8, wherein the second piston comprises a piston body, the piston body further including a flange; and wherein the first piston comprises a recess configured to receive the flange therein, the flange and the first piston translatable relative to each other.

10. The pump of claim 9, wherein the first piston further comprises a throughbore and a plurality of circumferentially spaced grooves formed in a surface bounding the throughbore, each groove enabling fluid communication between the throughbore and third second subchamber when the flange is seated within the recess of the first piston.

11. The pump of claim 9, wherein the flange comprises a frustoconical outer surface and the first piston comprises a frustoconical outer surface.

12. The pump of claim 8, further comprising a pressure sensor operable to sense a pressure of the working fluid exhausted from the cylinder and wherein the hydraulic system is actuatable to add hydraulic fluid to the third subchamber when the pressure is below a pre-selected minimum value, whereby the second piston strokes out, and actuatable to relieve hydraulic fluid from the third subchamber when the third pressure exceeds a pre-selected maximum value, whereby the second piston strokes back.

13. The pump of claim 8, wherein the housing comprises a tubular member having a wire coil therein, the coil having a resistance that changes in response to an applied pressure load.

14. The pump of claim 8:

wherein the second piston comprises:

a piston body translatable relative to the housing; and a bladder coupled between the piston body and the housing, the bladder separating the first subchamber and the second subchamber; and wherein the hydraulic system is actuatable to:

deliver hydraulic fluid to the first subchamber, whereby the bladder flexes and the piston body translates in a first direction toward the first position; and deliver hydraulic fluid to the second subchamber, whereby the bladder flexes and the piston body translates in a second direction toward the second position.

15. The pump of claim 14, wherein the first piston comprises a piston cover at least partially disposed within the housing, the piston cover translatable relative to the housing and relative to the piston body and having a bore configured to receive an end of the piston body.

16. The pump of claim 15, wherein the piston cover further comprises a flange aligning the bore with the end of the piston body and having a plurality of circumferentially spaced throughbores enabling hydraulic fluid to pass therethrough.

17. The pump of claim 15, wherein the first piston further comprises a bladder coupled between the piston cover and the housing, the bladder separating the second subchamber from the third subchamber.

18. The pump of claim 17, wherein each of the bladders comprises an inner layer disposed between two outer layers, the inner layer comprising a material that is more compliant than at least one of the outer layers to lubricate relative motion between the outer layers.

19. The pump of claim 17, further comprising a cylinder coupled to the housing and wherein the second piston is translatably disposed within the cylinder, the second piston drawing a working fluid into the cylinder when translating in the first direction and exhausting the working fluid from the cylinder when translating in the second direction.

20. The pump of claim 19, wherein the hydraulic system is fluidicly coupled to the third subchamber and actuatable to adjust a volume of hydraulic fluid within the third subchamber, whereby a pressure of the working fluid exhausted from the cylinder is maintained within a pre-selected range.

21. The pump of claim 14, wherein the bladder extends between a circumferential outer surface of the piston body and an circumferential inner surface of the housing.

22. A pump comprising:

a housing;

a piston assembly separating the hydraulic chamber into at least a first subchamber and a second subchamber, the piston assembly comprising a piston body translatable relative to the housing;

a piston cover at least partially disposed within the housing, the piston cover translatable relative to the housing and relative to the piston body and configured to receive an end of the piston body during operation of the pump;

a piston extending between the piston cover and the housing, the piston and the piston cover separating the second subchamber from a third subchamber; and a hydraulic system fluidicly coupled to the first subchamber and the second subchamber, the hydraulic system actuatable to:

deliver hydraulic fluid to the second subchamber, whereby the second subchamber is pressurized and the piston body translates in a first direction from a stroked back position toward a stroked out position;

deliver hydraulic fluid to the first subchamber, whereby the first subchamber is pressurized and the piston body translates in a second direction opposite the first direction from the stroked out position toward the stroked back position.

23. The pump of claim 22, wherein the hydraulic system is actuatable to adjust a volume of hydraulic fluid within the third subchamber to move the piston cover relative to the piston body.

24. The pump of claim 22, wherein the piston cover further comprises a bore configured to receive an end of the piston body and a flange aligning the bore with the end of the piston body and having a plurality of circumferentially spaced throughbores enabling hydraulic fluid to pass therethrough.

25. The pump of claim 24, further comprising:

a fourth subchamber defined between the bore of the piston cover and the end of the piston body; and a flow restrictor disposed between the fourth subchamber and the second subchamber.

26. The pump of claim 25, wherein the flow restrictor includes an annular space between an inner surface of the bore and an outer surface of the piston body.

* * * * *